US011143057B2

(12) United States Patent
Olivotti

(10) Patent No.: US 11,143,057 B2
(45) Date of Patent: Oct. 12, 2021

(54) HEAT MACHINE CONFIGURED FOR REALIZING HEAT CYCLES AND METHOD FOR REALIZING HEAT CYCLES BY MEANS OF SUCH HEAT MACHINE

(71) Applicant: I.V.A.R. S.P.A., Prevalle (IT)

(72) Inventor: Sergio Olivotti, Vicenza (IT)

(73) Assignee: I.V.A.R. S.P.A., Prevalle (IT)

( * ) Notice: Subject to any disclaimer, the term of this patent is extended or adjusted under 35 U.S.C. 154(b) by 0 days.

(21) Appl. No.: 16/626,914

(22) PCT Filed: Jun. 12, 2018

(86) PCT No.: PCT/IB2018/054254

§ 371 (c)(1),
(2) Date: Dec. 27, 2019

(87) PCT Pub. No.: WO2019/008457

PCT Pub. Date: Jan. 10, 2019

(65) Prior Publication Data

US 2020/0131942 A1 Apr. 30, 2020

(30) Foreign Application Priority Data

Jul. 3, 2017 (IT) ..... 102017000074290

(51) Int. Cl.
*F01K 13/00* (2006.01)
*F01C 1/077* (2006.01)
(Continued)

(52) U.S. Cl.
CPC ..... *F01K 13/006* (2013.01); *F01C 1/077* (2013.01); *F01D 15/10* (2013.01); *F01K 7/16* (2013.01);
(Continued)

(58) Field of Classification Search
CPC ..... F01K 13/006; F01K 7/16; F01K 13/02; F01K 23/10; F01K 25/08; F01K 7/36;
(Continued)

(56) References Cited

U.S. PATENT DOCUMENTS 2,248,484 A * 7/1941 Bancroft ..... F02G 3/02 60/604
4,338,067 A * 7/1982 Greenfield ..... F01C 1/077 418/36
(Continued)

FOREIGN PATENT DOCUMENTS

DE 29 10 990 A1 10/1980
EP 0 553 524 A1 8/1993
(Continued)

OTHER PUBLICATIONS

Sep. 6, 2018 International Search Report issued in International Patent Application No. PCT/IB2018/054254.
(Continued)

*Primary Examiner* — Hoang M Nguyen
(74) *Attorney, Agent, or Firm* — MH2 Technology Law Group LLP

(57) ABSTRACT

A heat machine for realizing a heat cycle, operating with a thermal fluid includes a drive unit. A first rotor and a second rotor, each having three pistons slidable in an annular chamber, wherein the pistons delimit six variable-volume chambers. The drive unit includes a transmission to convert the rotary motion with first and second periodically variable angular velocities of said first and second rotor, offset from each other, into a rotary motion at a constant angular velocity. The heat machine further includes a compensation tank, to accumulate the compressed fluid from the drive unit, a regenerator to preheat the fluid, a heater to superheat the fluid circulating in the serpentine coil, a burner, to supply the thermal energy to the heater; wherein the regenerator, in
(Continued)

fluid communication with the drive unit, is configured to acquire energy-heat from the exhausted fluid and to preheat the fluid sent to the heater.

15 Claims, 10 Drawing Sheets

(51) Int. Cl.

| | |
|---|---|
| ***F01D 15/10*** | (2006.01) |
| ***F01K 7/16*** | (2006.01) |
| ***F01K 13/02*** | (2006.01) |
| ***F01K 23/10*** | (2006.01) |
| ***F01K 25/08*** | (2006.01) |

(52) U.S. Cl.
CPC ..... *F01K 13/02* (2013.01); *F01K 23/10* (2013.01); *F01K 25/08* (2013.01)

(58) Field of Classification Search
CPC .. F01K 13/00; F01C 1/077; F01C 1/18; F01D 15/10
USPC ..... 60/650, 653, 677–680, 682–684
See application file for complete search history.

(56) References Cited

U.S. PATENT DOCUMENTS

| | | | | |
|---|---|---|---|---|
| 5,224,847 | A | 7/1993 | Kurisu | |
| 6,461,127 | B1 * | 10/2002 | Kim | F01C 17/00 418/36 |
| 7,461,626 | B2 * | 12/2008 | Kimes | B60K 6/00 123/245 |
| 10,280,806 | B2 * | 5/2019 | Olivotti | F01C 1/063 |
| 2017/0167303 | A1 | 6/2017 | Olivotti | |

FOREIGN PATENT DOCUMENTS

| | | | |
|---|---|---|---|
| WO | 2014/076637 | A1 | 5/2014 |
| WO | 2015/114602 | A1 | 8/2015 |

OTHER PUBLICATIONS

Sep. 6, 2018 Written Opinion of the International Searching Authority issued in International Patent Application No. PCT/IB2018/054254.

* cited by examiner

HEAT MACHINE CONFIGURED FOR REALIZING HEAT CYCLES AND METHOD FOR REALIZING HEAT CYCLES BY MEANS OF SUCH HEAT MACHINE

FIELD OF THE INVENTION

The present invention relates to a "heat machine", comprising a "rotary drive unit" provided with a motion transmission system, and some specific functional configurations thereof, and which, despite having Joule-Ericsson heat cycles as its original reference, supplements and improves them, achieving an innovative combined heat cycle, operating with a mixture of air and aqueous vapour, in order to obtain a greater unit power, a considerable increase in overall efficiency and an efficient lubrication of the cylinder in which the pistons rotate. The present invention further relates to a method for realizing heat cycles.

In particular, the present invention can have application in the production of electrical energy from renewable sources, in the field of the combined generation of electrical energy and heat, in the field of transport and in the automotive sector in general.

BACKGROUND OF THE INVENTION

Some historical considerations concerning thermodynamic cycles were already set forth in the description of the patent application published with the number WO2015/114602A1 in the name of the same Applicant, and it is therefore deemed useful to mention in the following only the most significant parts tied to the subject matter of the present invention and regarding use as a heat machine characterized by a new "pulsating heat cycle", whose origin lies in Joule-Ericsson cycles.

Historical Notes on the Ericsson Engine

The first design and production of the Ericsson "hot air" engine took place in 1826, initially without regeneration and with a modest overall efficiency.

In 1833, a new Ericsson engine was built, provided with valves and a heat recuperator, and a considerable increase in overall efficiency was obtained.

In 1853 an Ericsson "hot air" engine was built, which was used on a ship; it was able to generate 220 kW of power with an overall efficiency of 13.3%.

In subsequent years, several thousand Ericsson engines were produced and used on ships and in industrial laboratories in the United States.

Between 1855 and 1860 nearly 3,000 low-power (600 W) Ericsson engines were built. They were sold and used in the United States, Germany, France and Sweden.

These engines possessed high reliability and robustness, so much so that one engine installed in a lighthouse remained in operation for over 30 years after being put into service.

For reasons that have not yet been wholly clarified, the Ericsson engine was then first supplanted by conventional steam engines and then by internal combustion engines, more powerful and compact in size.

Schematic Representation of the Closed-Circuit Ericsson Cycle

The Ericsson cycle, characterized by the use of a reciprocating motion engine operating in a closed circuit, is schematically represented in FIG. 4, and is composed of the following main components:

E_expansion cylinder;

E1-E2_expansion cylinder inlet-discharge valves;

R_heat exchanger/recuperator;

K_heat exchanger/sink;

C_compression cylinder;

C1-C2_compression cylinder inlet-discharge valves;

H_"thermal fluid" heater.

With reference to said FIG. 4, the Ericsson engine works in the following manner:

- in cylinder C, as a result of the downward movement of the piston, the thermal fluid (at temperature T1), passing through the valve C1, is first suctioned and then, as a result of the upward movement of the piston, is compressed until reaching the maximum value corresponding to the predetermined ratio;
- the compressed thermal fluid then passes through the valve C2 and exits from the cylinder C (at temperature T2);
- the thermal fluid then passes into the recuperator R, where it receives heat and heats up (to temperature T2');
- the thermal fluid then passes into the heater H, where it receives heat and heats up further (to temperature T3);
- the thermal fluid then passes through the valve E1 and enters the cylinder E where, by expanding, it brings about the downward movement of the piston, producing useful work.
- the already expanded thermal fluid, as a result of the upward movement of the piston, is then discharged from the cylinder and (at a reduced temperature T4) passes through the valve E2;
- the thermal fluid then passes through the recuperator R, where it surrenders heat (until reaching a reduced temperature T4');
- the thermal fluid then passes through the sink K, where it surrenders further heat (until reaching temperature T1) and from where a new cycle can begin, perfectly identical to the previous one.

Schematic Representation of the Joule Closed Cycle

The Joule cycle, characterized by the use of a turbo-machine with continuous rotary motion, operating in a closed circuit, is schematically represented in FIG. 5, and is composed of the following main components:

E_expansion turbine;

R_heat exchanger/recuperator;

K_heat exchanger/sink;

C_compression turbine;

H_"thermal fluid" heater.

With reference to said FIG. 5, the turbo-machine of Joule operates in the following manner:

- as a result of the fast rotary movement of the turbine C, the thermal fluid (at temperature T1) is suctioned and compressed to the maximum predetermined value;
- the compressed thermal fluid then exits from the turbine C (at temperature T2);
- the thermal fluid then passes into the recuperator R, where it receives heat and heats up (to temperature T2');
- the thermal fluid then passes into the heater H, where it receives heat and heats up further (to temperature T3);
- the thermal fluid then enters the turbine E, where, by expanding, it brings about the rotary movement of the turbine itself, producing useful work.
- the already expanded thermal fluid is then discharged from the turbine E and (at a reduced temperature T4);
- the thermal fluid then passes through the recuperator R, where it surrenders heat (until reaching a reduced temperature T4');
- the thermal fluid then passes through the sink K, where it surrenders further heat (until reaching temperature T1), concluding the cycle.

General Considerations

Overall, various heat machines functioning with diversified thermodynamic cycles have been developed and others are still at an experimental stage.

However, the Applicant has found that even already industrialized solutions have many limitations. This applies, in particular for the engines used to drive small and medium power autonomous electric generators (below 50 KWh).

Today, in practice, the following drive units are customarily used to drive electric generators:

- reciprocating internal combustion engines, which are mechanically complicated, noisy, are particularly polluting and require a great deal of maintenance;
- Stirling engines, which, though less polluting, must operate at low speed (limitation imposed by the use of an alternating flow regenerator) in order to have a good overall efficiency and are therefore very heavy and cumbersome.
- gas turbines, which besides being particularly polluting, are not economically competitive in small-scale applications.
- expanders using the Rankine or Rankine-Hirn cycle, which, given the need to use a steam generator of a certain size, can be strongly competitive only in fixed cogeneration applications and require further technological innovations in order to be profitably used also in small-scale mobile applications.

In general, all of the prior art solutions, in addition to the problems of pollution, low efficiency, mechanical complexity and high maintenance costs, are also characterized by a cost-benefit ratio that is not particularly satisfactory, which has greatly limited the dissemination of cogeneration in the market of multi-occupancy buildings and residential dwellings.

The Applicant has also observed that if one wishes to extend the use of such heat machines to vehicles and micro cogeneration in a domestic setting, compactness and overall efficiency are fundamental.

Innovative Solution Proposed by the Applicant.

In this context, the Applicant has set the objective of proposing a new "heat machine" capable of operating with an innovative combined heat cycle using hot air and aqueous vapour, whereby it is possible to exploit greater energy by recovering it during the stages of the cycle itself, with a considerable increase in the unit power and overall efficiency, also solving the large problem of lubricating the cylinder where the pistons of the known drive unit slide.

In particular, compared to Ericsson and Joule cycles, the innovations introduced with the present invention can be identified in three different possible operating configurations of the heat cycle.

In the first configuration, which comprises solely the injection of water downstream of the regeneration, the following results are obtained:

- lubrication of the cylinder of the drive unit, with a reduction in friction and wear and consequent increase in mechanical efficiency;
- increase in the unit power, due to the increase in the flow rate and molecular weight of the thermal fluid that is expanded in the cylinder;
- no increase in negative compression work, since the water introduced is condensed and separated from the air before the suctioning thereof;
- slight decrease in overall efficiency, since the amount of heat absorbed by evaporation is very high per unit of mass.

In the second configuration, which comprises the injection of saturated vapour obtained with a recovery of energy downstream of the regeneration, the following results are obtained:

- lubrication of the cylinder of the drive unit, with a reduction in friction and wear and consequent increase in mechanical efficiency;
- increase in the unit power, due to the increase in the flow rate and molecular weight of the thermal fluid that is expanded in the cylinder;
- no increase in negative compression work, since the water introduced is condensed and separated from the air before the suctioning thereof;
- increase in the overall efficiency, since the amount of heat absorbed by evaporation is compensated for by the recovery of energy achieved with the evaporator.

In the third configuration, which comprises the injection of superheated vapour obtained with a recovery of energy downstream of the regeneration and the recovery of energy from the combustion fumes, the following results are obtained:

- lubrication of the cylinder of the drive unit, with a reduction in friction and wear and consequent increase in mechanical efficiency;
- further increase in the unit power, due to the increase in the flow rate, molecular weight and enthalpy of the thermal fluid that is expanded in the cylinder;
- no increase in negative compression work, since the water introduced is condensed and separated from the air before the suctioning thereof;
- further increase in the overall efficiency, since the amount of heat absorbed by evaporation is compensated for by the recovery of energy achieved with the evaporator and the increase in enthalpy obtained with the superheating.

Therefore, the object at the basis of the present invention, in the various aspects and/or embodiments thereof, is to remedy one or more of the drawbacks of the prior art solutions by providing a new "heat machine" capable of using multiple heat sources and capable of generating a great deal of mechanical energy (work), being able to be used in any place and for any purpose, but preferably for the production of electrical energy.

A further object of the present invention is to provide a new "heat machine" characterized by high thermodynamic efficiency and an excellent power-to-weight ratio.

A further object of the present invention is to propose a new "heat machine" provided with a "drive unit" characterized by a mechanical structure that is simple and can be easily built.

A further object of the present invention is to be able to produce a new "heat machine" characterized by a reduced cost of production.

These objects, and any others that will become more apparent in the course of the following description, are substantially achieved by a new "heat machine" that relies on a "drive unit" characterized by a series of particular aspects.

In one aspect, the present invention relates to a heat machine for realizing a heat cycle, the heat machine operating with a thermal fluid and comprising:

- a drive unit comprising:
  - a casing delimiting therein an annular chamber and having appropriately dimensioned inlet or discharge openings in fluid communication with conduits external to the annular chamber, wherein each inlet or discharge opening is angularly spaced from the adjacent inlet and discharge openings so as to define an expansion/compression path for a working fluid in the annular chamber;

a first rotor and a second rotor rotatably installed in said casing; wherein each one of the two rotors has three pistons that are slidable in the annular chamber; wherein the pistons of one of the rotors are angularly alternated with the pistons of the other rotor; wherein angularly adjacent pistons delimit six variable-volume chambers;

a primary shaft operatively connected to said first and second rotor;

a transmission that is operatively interposed between said first and second rotor and the primary shaft and configured to convert the rotary motion with respective first and second periodically variable angular velocities of said first and second rotor that are offset relative to each other into a rotary motion having a constant angular velocity of the primary shaft; wherein the transmission is configured to confer, on the periodically variable angular velocity of each of the rotors, six periods of variation for each complete revolution of the primary shaft.

In one aspect, said drive unit is a rotary volumetric expander operating with said thermal fluid.

In one aspect, the heat machine comprises a first section of the drive unit where, following the movement of the two pistons away from each other, the thermal fluid, passing through the inlet opening, is suctioned into the chamber.

In one aspect, the heat machine comprises a second section of said drive unit, where, following the movement of the two pistons towards each other, the previously suctioned thermal fluid is compressed in the chamber and then, on passing through the discharge opening, a pipe and a check valve, it is conveyed into a compensation tank.

In one aspect, the heat machine comprises said compensation tank, configured to accumulate the compressed thermal fluid to make it available, via specific pipes and the check valve, for subsequent use thereof, in a continuous mode.

In one aspect, the heat machine comprises a regenerator, in fluid communication via specific pipes and configured to preheat the thermal fluid prior to its entry into a heater.

In one aspect, the heat machine comprises said heater, configured to superheat the thermal fluid circulating in the serpentine coil (i.e. in the pipe placed around the combustion chamber and defining the heater), using the thermal energy produced by a burner.

In one aspect, the heat machine comprises said burner with a combustion chamber attached thereto, said burner being configured to operate with various types of fuel and being capable of supplying the necessary thermal energy to the heater.

In one aspect, the heat machine comprises a third section of said drive unit, in fluid communication with said heater, via specific pipes, and configured to receive, via the inlet openings, the thermal fluid heated to a high temperature under pressure in the heater so as to have it expand in the chambers, which are delimited by the pistons, respectively, for the purpose of having said pistons rotate and produce work.

In one aspect, the heat machine comprises a fourth section of said drive unit, in fluid communication with the regenerator through the discharge openings and specific pipes, and wherein, due to the reduction in volume of the two chambers brought about by the movement of the two pairs of pistons towards each other, the exhausted thermal fluid is forcedly expelled.

In one aspect, said regenerator, in fluid communication with said drive unit, is configured to acquire heat-energy from the exhausted thermal fluid and to use it to preheat the thermal fluid to be sent to the heater.

In one aspect (see the schematic representation in FIG. 6), the first section of the drive unit is in fluid connection with the external environment via a specific pipe, so that the ambient air can be suctioned into the chamber.

In one aspect (see the schematic representation in FIG. 6), the heat machine comprises a metering pump in fluid connection with a distilled water tank and arranged so as to enable a predefined amount of distilled water to be injected in the air circuit by means of an injector, said predefined amount being capable of increasing the unit power of the drive unit and of ensuring lubrication of the cylinder.

In one aspect (see the schematic representation in FIG. 7), the heat machine comprises a cooler operatively interposed between the low temperature outlet of the regenerator and the inlet of the heater.

In one aspect (see the schematic representation in FIG. 7), the thermal fluid, exiting from the cooler at temperature T1, passes into a specific pipe, passes through a condensate trap, where the water in the thermal fluid is condensed and separated from the air, passes into a further specific pipe at temperature T1', passes through the suctioning opening and following the movement of the two pistons away from each other, is suctioned into the chamber of said first section.

In one aspect (see the schematic representation in FIG. 7), pushed by a high-pressure pump, the condensate water previously extracted from the air by the trap travels through specific pipes and reaches an injector arranged so as to inject, in the air circuit, a predefined amount of condensate water, which is capable of increasing the unit power of the drive unit and of ensuring lubrication of the cylinder.

In one aspect (see the schematic representation in FIG. 8), the heat machine comprises a cooler that is operatively interposed between the low temperature outlet of the regenerator and the inlet of the heater, and the thermal fluid, exiting from the cooler at temperature T1, passes into a pipe, passes through a condensate trap, where the water in the thermal fluid is condensed and separated from the air, passes into a further pipe at temperature T1', passes through the suctioning opening and following the movement of the two pistons away from each other, is suctioned into the chamber of said first section and, pushed by a high-pressure pump, the condensate water previously extracted from the air by the trap travels through specific pipes and reaches an evaporator that is configured to heat and vaporize the condensate water and send it to an injector arranged so as to inject, in the air circuit, a predefined amount of vaporized condensate water, which is capable of increasing the unit power of the drive unit and of ensuring lubrication of the cylinder.

In one aspect (see the schematic representation in FIG. 8), the evaporator is operatively interposed, with its high temperature side, between said high pressure pump and said injector, and the evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

In one aspect (see the schematic representation in FIG. 11), the heat machine comprises a cooler, which is operatively interposed between the low temperature outlet of the regenerator and the inlet of the heater, and the thermal fluid, exiting from the cooler at temperature T1, passes into a pipe, passes through a condensate trap, where the water in the thermal fluid is condensed and separated from the air, passes into a pipe at temperature T1', passes through the suctioning opening and, following the movement of the two pistons away from each other, is suctioned into the chamber of said first section and, pushed by a high-pressure pump, the condensate water previously extracted from the air by the trap travels through the pipes and reaches an evaporator, configured to heat and vaporize the condensate water and send it to a superheater, which, by extracting energy from the hot combustion fumes downstream of the burner, is configured to superheat the saturated vapour exiting from the evaporator, so as to supply energy thereto.

In one aspect (see the schematic representation in FIG. 11), the superheater is configured to send the vaporized and superheated condensate water to an injector, which is arranged so as to enable injection, in the air circuit, of a predefined amount of said superheated and vaporized condensate water, which is capable of further increasing the unit power of the drive unit and of ensuring lubrication of the cylinder.

In one aspect (see the schematic representation in FIG. 11), the evaporator is operatively interposed, with its high temperature side, between said high pressure pump and said superheater, and the evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

In one aspect (see the schematic representation in FIG. 12), the heat machine is provided with a cooling circuit comprising:

- a first recuperator, located upstream of the burner, where combustion air is drawn from the environment;
- a cooling unit (or interspace) associated with the drive unit;
- a second recuperator, located downstream of the burner and of the heater, and preferably downstream of said superheater, along the exit path of the hot combustion fumes;
- a plurality of cooling pipes connecting in series said first recuperator, said cooling unit and said second recuperator, so as to form a circular path, and bearing an amount of cooling fluid (preferably water);
- a cooling pump, located in said circuit and that is operatively active on one pipe of said plurality of cooling pipes so as to bring about circulation of said cooling fluid in the cooling circuit.

In one aspect (see the schematic representation in FIG. 12), the first recuperator is configured to cool said cooling fluid by surrendering heat-energy to said combustion air, the cooling unit is configured to cool the drive unit by transfer of heat-energy from the drive unit to the cooling fluid, which undergoes an increase in temperature, and the second recuperator is configured to heat said cooling fluid by acquiring heat-energy from the hot combustion fumes.

In one aspect (see the schematic representations in FIGS. 6, 7, 8, 11, 12), the heat machine comprises an auxiliary hydraulic circuit. In one aspect the auxiliary hydraulic circuit comprises:

- an auxiliary recuperator, located downstream of the burner and of the heater, and preferably downstream of the superheater, along the exit path of the hot combustion fumes;
- a plurality of auxiliary pipes configured to pass through said auxiliary recuperator and to be connected with one or more auxiliary uses, preferably devices for space heating and/or production units for domestic hot water;
- an auxiliary pump, located in said circuit and that is operatively active on one pipe of said plurality of auxiliary pipes so as to bring about circulation in said auxiliary circuit.

In one aspect the auxiliary recuperator is configured to recover as much energy as possible from the combustion fumes and to transmit it to the fluid circulating in said auxiliary circuit, said energy thus being available for said auxiliary uses.

In one aspect, the heat machine comprises a fan upstream of the burner and configured to draw combustion air from the environment and to send it forcedly to said burner to feed the combustion process.

In one aspect, the heat machine comprises one or more check vales located along the pipes of the heat machine and configured to facilitate circulation of the thermal fluid in a unidirectional manner and prevent the outflow of the thermal fluid in the opposite direction.

In an independent aspect thereof, the present invention relates to a method for realizing a heat cycle, the method operating with a thermal fluid and comprising the steps of:

arranging a heat machine;

carrying out a plurality of steps.

In one aspect, said plurality of steps comprises:

- setting the primary shaft into motion and the transmission of the drive unit, setting the six pistons into motion;
- activating the burner and starting up the combustion process;
- when the thermal fluid circulating in the heat machine has reached a pre-established minimum operating state, the drive unit produces the work needed to be able to turn independently;
- following the movement of the two pistons away from each other, the thermal fluid is suctioned into the chamber through the suctioning opening;
- following the movement of the two pistons towards each other, the previously suctioned thermal fluid is compressed in the chamber, undergoes an increase in temperature from T1' to T2, passes through the discharge opening and reaches the compensation tank;
- with the intermittency determined by the rotation of the pistons and the resulting opening/closing of the inlet openings, the thermal fluid flows out from the tank and passes through the regenerator, where it undergoes an increase in temperature from T2 to T2';
- the thermal fluid passes through the heater, where it receives heat-energy and increases in temperature from T2" to T3;
- rotating in the annular cylinder, when the pistons open the inlet openings, the superheated thermal fluid is admitted into the expansion chambers where it expands, with a decrease in its temperature from T3 to T4 and, as it makes the pistons rotate, it produces useful work.

In one aspect, in said step of arranging a heat machine, said heat machine is in accordance with a combination of one or more of the presents aspects and/or one or more of the accompanying claims.

In one aspect (see the schematic representation in FIG. 6), following the movement of the pistons towards each other, the chambers diminish in volume, the exhausted thermal fluid is expelled from the drive unit, passes through the discharge openings, and passes through the regenerator, where it surrenders part of the heat-energy still possessed and undergoes a decrease in temperature from T4 to T4'.

In one aspect (see the schematic representation in FIG. 6), in the step of suctioning the thermal fluid into the chamber, said thermal fluid is air suctioned from the environment at temperature T1'.

In one aspect (see the schematic representation in FIG. 6), the method comprises the steps of:

drawing distilled water from the tank;

activating the metering pump and introducing a given amount of distilled water into the circuit by means of the injector, thereby bringing about a decrease in the temperature of the resulting thermal fluid from T2' to T2";

following the step of passing through the regenerator, the exhausted thermal fluid is discharged into the atmosphere.

In one aspect (see the schematic representation in FIG. 7), the method further comprises the following steps:

the thermal fluid, exiting from the cooler at temperature T1, passes into a pipe, passes through a condensate trap, where the water in the thermal fluid is condensed and separated from the air, passes into a pipe at temperature T1', passes through the suctioning opening and, following the movement of the two pistons away from each other, is suctioned into the chamber of said first section;

pushed by a high-pressure pump, the condensate water previously extracted from the air by the trap travels through the pipes and reaches an injector arranged so as to enable injection, in the air circuit, of a predefined amount of condensate water, which is capable of increasing the unit power of the drive unit and of ensuring lubrication of the cylinder.

In one aspect (see the schematic representation in FIG. 8), the method further comprises the following steps:

the thermal fluid, exiting from the cooler at temperature T1, passes into a pipe, passes through a condensate trap, where the water in the thermal fluid is condensed and separated from the air, passes into a pipe at temperature T1', passes through the suctioning opening and, following the movement of the two pistons away from each other, is suctioned into the chamber of said first section;

pushed by a high-pressure pump, the condensate water previously extracted from the air by the trap travels through the pipes and reaches an evaporator, configured to heat and vaporize the condensate water and send to an injector arranged so as to enable injection, in the air circuit, of a predefined amount of condensate water, which is capable of increasing the unit power of the drive unit and of ensuring lubrication of the cylinder;

wherein said evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

In one aspect (see the schematic representation in FIG. 11), the method further comprises the following steps:

the thermal fluid, exiting from the cooler at temperature T1, passes into a pipe, passes through a condensate trap, where the water in the thermal fluid is condensed and separated from the air, passes into a pipe at temperature T1', passes through the suctioning opening and, following the movement of the two pistons away from each other, is suctioned into the chamber of said first section;

pushed by a high-pressure pump, the condensate water previously extracted from the air by the trap travels through the pipes and reaches an evaporator that is configured to heat and vaporize the condensate water and send it to a superheater, which, by extracting energy from the hot combustion fumes downstream of the burner, is configured to superheat the saturated vapour exiting from the evaporator, so as to supply energy thereto;

wherein said superheater is configured to send the superheated and vaporized condensate water to an injector, which is arranged so as to enable injection, in the air circuit, of a predefined amount of said superheated and vaporized condensate water, which is capable of further increasing the unit power of the drive unit, of increasing the overall efficiency and of ensuring lubrication of the cylinder, and wherein said evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

In one aspect (see the schematic representation in FIG. 12), the method further comprises the following steps:

arranging a cooling circuit comprising:

a first recuperator, upstream of the burner, where combustion air is drawn from the environment;

a cooling unit (or interspace) associated with the drive unit;

a second recuperator, located downstream of the burner and of the heater, and preferably downstream of said superheater, along the exit path of the hot combustion fumes;

a plurality of cooling pipes connecting in series said first recuperator, said cooling unit (or interspace) and said second recuperator, so as to form a circular path, and bearing an amount of cooling fluid (preferably water);

a cooling pump, located in said circuit and that is operatively active on one pipe of said plurality of cooling pipes so as to bring about circulation of said cooling fluid in the cooling circuit;

carrying out the following steps:

cooling the cooling fluid by means of said first recuperator by surrendering heat-energy to said combustion air;

cooling, by means of said cooling unit, the drive unit by transfer of heat-energy from the drive unit to the cooling fluid, which undergoes an increase in temperature;

heating, by means of said second recuperator, said cooling fluid by acquiring heat-energy from the hot combustion fumes.

In one aspect (see the schematic representations in FIGS. 6, 7, 8, 11, 12), the method further comprises the following steps:

arranging an auxiliary hydraulic circuit comprising:

an auxiliary recuperator, located downstream of the burner and of the heater, and preferably downstream of said superheater, along the exit path of the hot combustion fumes;

a plurality of auxiliary pipes configured to pass through said auxiliary recuperator and to be connected with one or more auxiliary uses, preferably devices for space heating and/or production units for domestic hot water;

an auxiliary pump, located in said circuit and that is operatively active on one pipe of said plurality of auxiliary pipes so as to bring about circulation in said auxiliary circuit;

carrying out the following steps:

recovering as much energy as possible from the combustion fumes, by means of said auxiliary recuperator;

transmitting said energy to the fluid circulating in said auxiliary circuit;

providing said energy for auxiliary uses.

In one aspect, the drive unit is substantially composed of:

an engine block formed by a casing provided with an internal cavity defining a toroidal cylinder (or annular cylinder);

two triads of pistons rotatably housed inside the toroidal cylinder (or annular cylinder), each triad being connected to a respective driving rotor, with the pistons of the two triads alternating with each other;

a three-shaft transmission a with a train of four three-lobe gears housed in a specific case, configured and designed to transmit motion from and/or to the two triads of pistons, the transmission comprising a primary shaft (or drive shaft), a first secondary shaft and a second secondary shaft, each secondary shaft being connected, via driving rotors to a respective triad of piston;

a first rotor and a second rotor connected respectively to a first and a second auxiliary shaft and rotatably installed in the casing; wherein each of the two rotors is mechanically integral with three pistons which are angularly offset from each other by 120° and slidable in the annular chamber; wherein the pistons of one of the rotors are angularly alternated with the pistons of the other rotor so that the angularly adjacent pistons form and delimit each of the six variable-volume chambers that are created.

In one aspect, the annular chamber has a rectangular or square cross section and the pistons, being of mating shape, are respectively rectangular or square.

In one aspect, the annular chamber has a circular cross section (extending toroidally) and the pistons, being of mating shape, have a circular cross section (extending toroidally).

In one aspect, the toroidal cylinder (or annular cylinder) is provided with a number of mutually distinct inlet openings for the entry of a high-temperature thermal fluid into the cylinder and a number of mutually distinct discharge openings for evacuating the exhausted thermal fluid.

In one aspect, each of the six chambers expands three times and contracts three times per each complete revolution (360°) of the primary shaft.

In one aspect, all of the inlet/discharge openings, used for the passage of the thermal fluid, are fashioned on the casing of the toroidal (or annular) cylinder.

In one aspect the toroidal cylinder (or annular cylinder) is provided with one or more inlet openings for the entry of the cooled thermal fluid into the cylinder and one or more discharge openings for evacuating the compressed thermal fluid in the compensation tank.

In one aspect, by means of a manual or automatic angular rotation of the case containing the transmission, relative to the inlet/discharge openings, it is possible to time the phases of the heat cycle to come earlier or later in order to optimize thermodynamic efficiency.

In one aspect, by means of a manual or automatic angular rotation of the case containing the transmission, relative to the inlet/discharge openings, it is possible to time the phases of the heat cycle to come earlier or later in order to enable autonomous starting of the engine apparatus.

In one aspect, the first triad of pistons is an integral part of a first rotor and the second triad of pistons is an integral part of a second rotor.

In one aspect, the three pistons of each of the two rotors are angularly equidistant from one another. In one aspect, the three pistons of each of the rotors are rigidly connected together so as to rotate integrally with one another.

In one aspect, the first secondary shaft is solid and integrally joined at one end with a first three-lobe gear and at the opposite end with the first rotor.

In one aspect, the second secondary shaft is hollow and integrally joined at one end with a respective second three-lobe gear and at the opposite end with the second rotor.

In one aspect, the primary shaft (or drive shaft) is integrally joined with a first and a second three-lobe gear, positioned at 60° from each other.

In one aspect, the transmission of the drive unit comprises:

a first auxiliary shaft on which the first rotor is mounted;

a second auxiliary shaft on which the second rotor is mounted;

a first three-lobe gear and a second three-lobe gear keyed onto the primary shaft and angularly offset from each other by an angle of 60°;

a third three-lobe gear, keyed onto the first auxiliary shaft;

a fourth three-lobe gear, keyed onto the second auxiliary shaft;

wherein the first three-lobe gear is functionally operating with the third three-lobe gear and the second three-lobe gear is functionally operating with the fourth three-lobe gear.

In one aspect, the first auxiliary shaft is coaxially inserted in the second auxiliary shaft or vice versa.

In one aspect, the axis of the primary shaft is parallel to and appropriately distanced from the axis of the first shaft and second shaft.

In one aspect, each three-lobe gear has concave and/or flat and/or convex connecting portions between its lobes.

In one aspect, each three-lobe gear, as may be inferred from the definition thereof, has a substantially triangular profile.

In all aspects, a rotation having a constant angular velocity of the primary shaft (or drive shaft) brings about a periodic variation in the angular velocity of rotation of the two secondary shafts.

In all aspects, the primary shaft (or drive shaft) brings about a periodic cyclical variation of the angular velocity of the first and second secondary shafts and of the corresponding triads of pistons rotating inside the toroidal cylinder (or annular cylinder), enabling the creation of six distinct rotating chambers with a variable volume and ratio.

In one aspect, the transmission of motion between the pistons and the primary shaft (or drive shaft) is obtained with the train of three-lobe gears which connects the first and second secondary shafts to the primary shaft, characterized in that while the primary shaft (or drive shaft) rotates with a constant angular velocity, the two secondary shafts rotate with an angular velocity that is periodically higher than, equal to or lower than the primary shaft.

In one aspect, without prejudice to the inventive idea, the drive unit can be provided with any system whatsoever for transmitting motion between the two triads of pistons and the primary shaft (such as, for example, the one claimed in U.S. Pat. No. 5,147,191, EP0554227A1 and TW1296023B), it being possible to adopt any mechanism able to transform the rotary motion of the primary shaft, which has a constant angular velocity, into a rotary motion with a periodically variable angular velocity of the two secondary shafts, functionally connected to the two triads of pistons.

In all aspects, the drive unit can be configured, by means of suitable thermal fluid conveying conduits, in such a way that the various components and various sections can be operatively connected with the corresponding inlet/discharge openings of the drive unit.

In one aspect, the drive unit is completely devoid of inlet/discharge valves and the associated mechanisms, since the triads of pistons, by moving in the toroidal cylinder (or annular cylinder), themselves bring about the opening and the closing of the inlet/discharge openings for the thermal fluid.

In one aspect, the heat machine which uses the drive unit can be provided with check valves appropriately positioned in the thermal fluid conveying conduits, in such a way as to optimize the heat cycle by aiding the work of the pistons in the function of opening-closing the inlet/discharge openings.

In one aspect, the heat machine which uses the drive unit can comprise one or more thermal fluid heaters and/or recuperators configured in such a way as to be able to provide all the maximum energy serving to produce the useful work, while recovering as much as possible of all the energy that would otherwise be lost.

In one aspect, the drive unit is connected to a generator capable of producing electrical energy utilizable for any purpose.

In one aspect, the drive unit is capable of producing mechanical energy utilizable for any purpose.

In one aspect, the heat machine which uses the drive unit comprises a heat energy regulating system, configured to regulate the delivery pressure and/or temperature of the thermal fluid in the various stages of the process.

In one aspect, the drive unit can be configured so as to function with an original Joule-Ericsson operating cycle, as the drive unit can perform functions of compressing and expanding the thermal fluid.

In one aspect, the "heat machine" which uses the drive unit is configured to function with a new "pulsating heat cycle" using hot air and aqueous vapour, featuring unidirectional continuous motion of the thermal fluid.

In one aspect, the drive unit is suitable for being employed as an apparatus capable of producing mechanical energy using flows of thermal fluid heated with any source of heat.

In one aspect, the heating of the circulating thermal fluid can be achieved using a fuel burner (for example a gas burner) or any other external source of heat, such as, for example: solar energy, biomass, unrefined fuel, high-temperature industrial waste, or another source suitable for heating the thermal fluid itself to the minimum necessary temperature.

Additional features will become more apparent from the following detailed description of the heat machine of the present invention and of some preferred embodiments of the use thereof, regarding, respectively:

- a first functional configuration (see FIG. 6) regarding the new "open" operating cycle, wherein the thermal fluid (normally air) is supplemented with an injection of non-recyclable distilled water whose primary purpose is lubrication of the cylinder where the pistons slide and an increase in the unit power of the drive unit;
- a second functional configuration (see FIG. 7) regarding the new "closed" operating cycle, wherein the thermal fluid (normally air) is supplemented with an injection of condensed water, whose primary purpose is lubrication of the cylinder where the pistons slide and an increase in the unit power of the drive unit;
- a third functional configuration (see FIG. 8) regarding the new "closed" operating cycle, wherein the thermal fluid (normally air) is supplemented with an injection of saturated aqueous vapour, which, in addition to lubrication of the cylinder where the pistons slide and an increase in the unit power of the drive unit, also enables an improvement in the overall efficiency of the heat cycle;
- a fourth functional configuration (see FIG. 11) regarding the new "closed" operating cycle, wherein the thermal fluid (normally air) is supplemented with an injection of aqueous superheated vapour, which, in addition to lubrication of the cylinder where the pistons slide and a significant increase in the unit power of the drive unit, also enables a major improvement in the overall efficiency of the heat cycle;
- a fifth functional configuration (see FIG. 12) regarding the new "closed" operating cycle, where the thermal fluid (normally air) is supplemented with an injection of aqueous superheated vapour which, in addition to lubrication of the cylinder where the pistons slide and a significant increase in the unit power of the drive unit, enables a major improvement in the overall efficiency of the heat cycle and also enables complete heat-energy recovery of the fluids in circulation.

It should be noted first of all that the gas preferably used as a thermal fluid is common "air"; however, without prejudice to the inventive idea, any other gas that is better suited and more compatible with aqueous vapour can be used, as is presented and described below.

It is also useful to point out that, in the "rest" condition, the thermal fluids used (normally air and water) are at the same temperature as the surrounding environment and that in closed-circuit solutions, inside the cylinder and pipes, a pressure other than atmospheric pressure could also be chosen where appropriate.

In its completeness, the new heat cycle is carried out, in a continuous mode, in a number of steps of thermodynamic variation of the fluid: introduction, compression, heating, vaporization, superheating, expansion (which produces useful work), expulsion, and condensation, as described below for the five main configurations of the heat machine according to the present invention, which are given by way of non-limiting example.

The most complete functional configuration of the heat machine, represented in FIG. 12, relates to a heat machine (121), comprising a drive unit (1) in accordance with one or more of the preceding aspects, configured to realize a new thermodynamic cycle, conventionally defined as a "pulsating heat cycle", characterized by the use of a thermal fluid, preferably composed of air and distilled water, suitably heated, vaporized and superheated before of its expansion in the drive unit 1, in order to obtain a considerable increase in the unit power, a considerable increase in the overall efficiency and an efficient lubrication of the cylinder/piston system with aqueous vapour.

In this configuration, where the start of the cycle is made to coincide with the suction of cooled air, the heat machine comprises:

a "cooler" (43), adapted to extract heat from the thermal fluid in circulation, in order to cool it and increase the mass of air that will then be suctioned/compressed in the unit (1);

a four- or six-piston "drive unit" (1), having functions of "compressing" and "expanding" the circulating thermal fluid;

a "compensation tank" (44) provided with suitable check valves, adopted to optimize the "pulsating" circulation of the compressed thermal fluid;

a "regenerator" (42), adapted to extract heat from the exhausted thermal fluid which is expelled from the unit (1) to preheat the thermal fluid, which will then be heated;

an "evaporator" (95), adapted to transform the condensed water in vapour, extracting further energy from the exhausted thermal fluid which has already passed through the regenerator (42);

a "superheater" (96) which, by extracting energy from the hot combustion fumes, is capable of superheating the saturated vapour exiting from the "evaporator" (95) so as to provide it with energy, with a considerable advantage for the heat cycle;

a "heater" (41), which has the purpose of heating the circulating thermal fluid so as to provide it with the thermal energy necessary for the subsequent active expansion step, which produces work;

a discharger/separator (93), adapted to condense the aqueous vapour in circulation, so as to be able to reuse it in a continuous mode;

a high pressure pump (94), adapted to recirculate the condensed water;

an "injector" (97), adapted to bring about the best conditions for the introduction of the superheated vapour into the circuit;

an "exchanger" (98), a pump (99), a first "recuperator" (100), a second recuperator (101), adapted to maintain the drive unit (1) at an ideal operating temperature and to recover further energy from the combustion fumes, prior to their discharge into the atmosphere.

In particular, the motion of the circulating fluid in the heat machine is conditioned by the rotary movement of the pistons, which, by bringing about the opening/closing of the inlet/discharge openings, generate the very particular high-frequency "pulsating" effect that characterizes this new heat cycle. For example, a rotation speed of 1,000 rpm of the primary shaft corresponds to exactly 100 pulses per second of the circulating thermal fluid).

DESCRIPTION OF THE DIAGRAMS AND DRAWINGS

With reference to the accompanying diagrams and drawings, it is noted that the same are provided solely by way of illustration and not by way of limitation; in them:

FIG. 1 shows a schematic front view of a drive unit utilizable in the present invention;

FIG. 2*a* illustrates a side sectional view of the central body of the drive unit of FIG. 1;

FIG. 2*b* is a side sectional view of a variant of the central body of the drive unit of FIG. 1, with a section of the motion transmission system;

Figure 6:
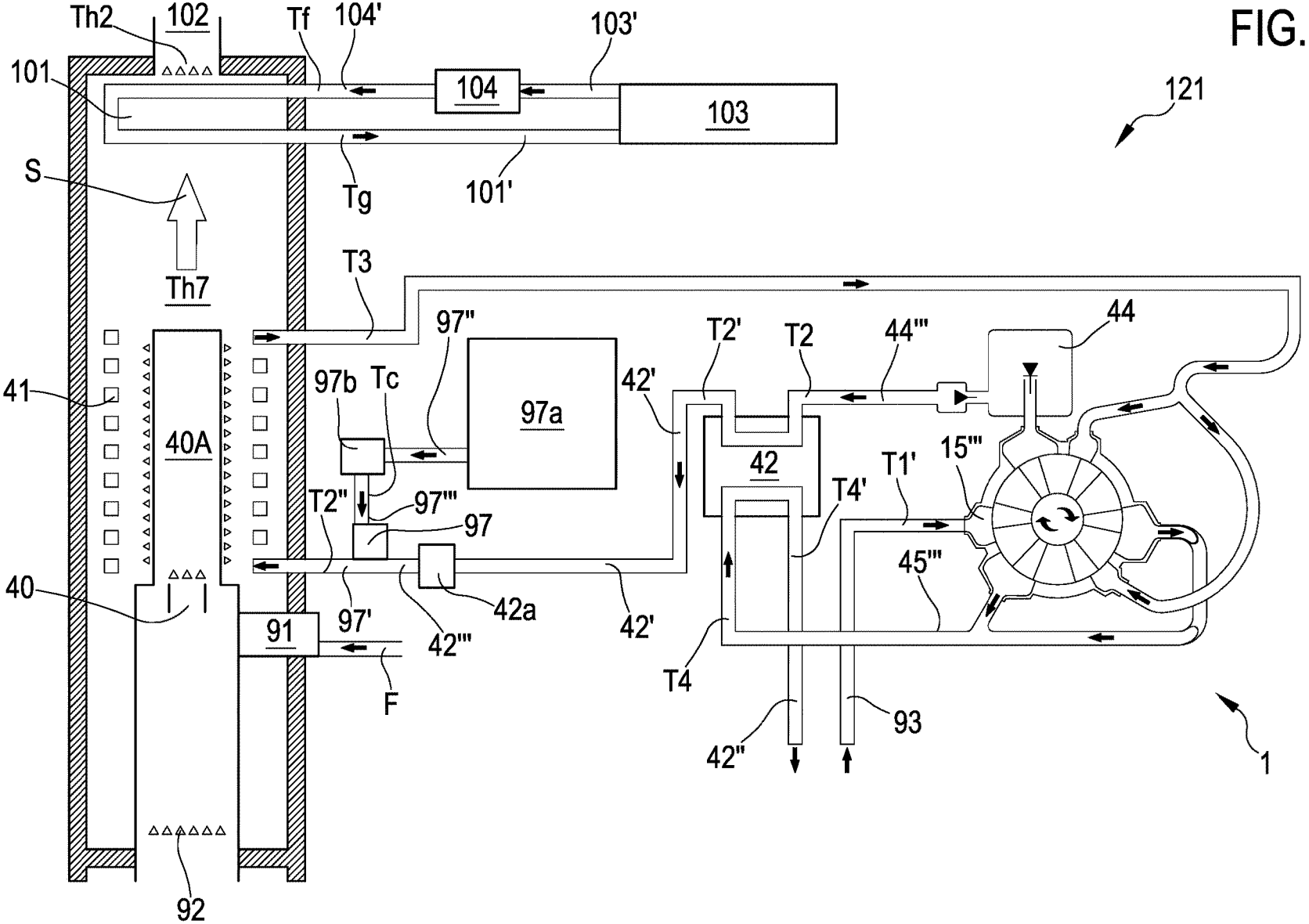
Figure 7:
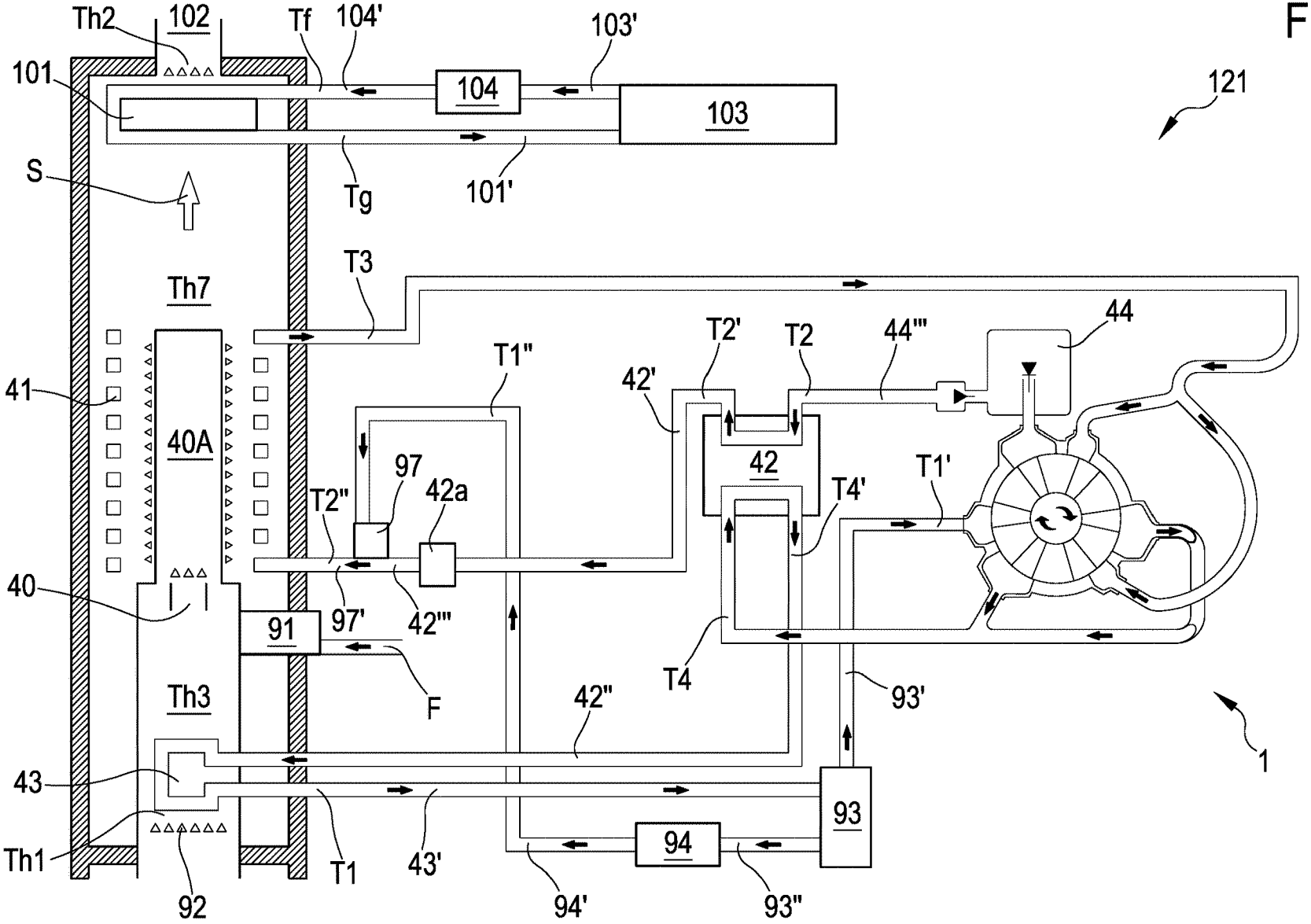
Figure 8:
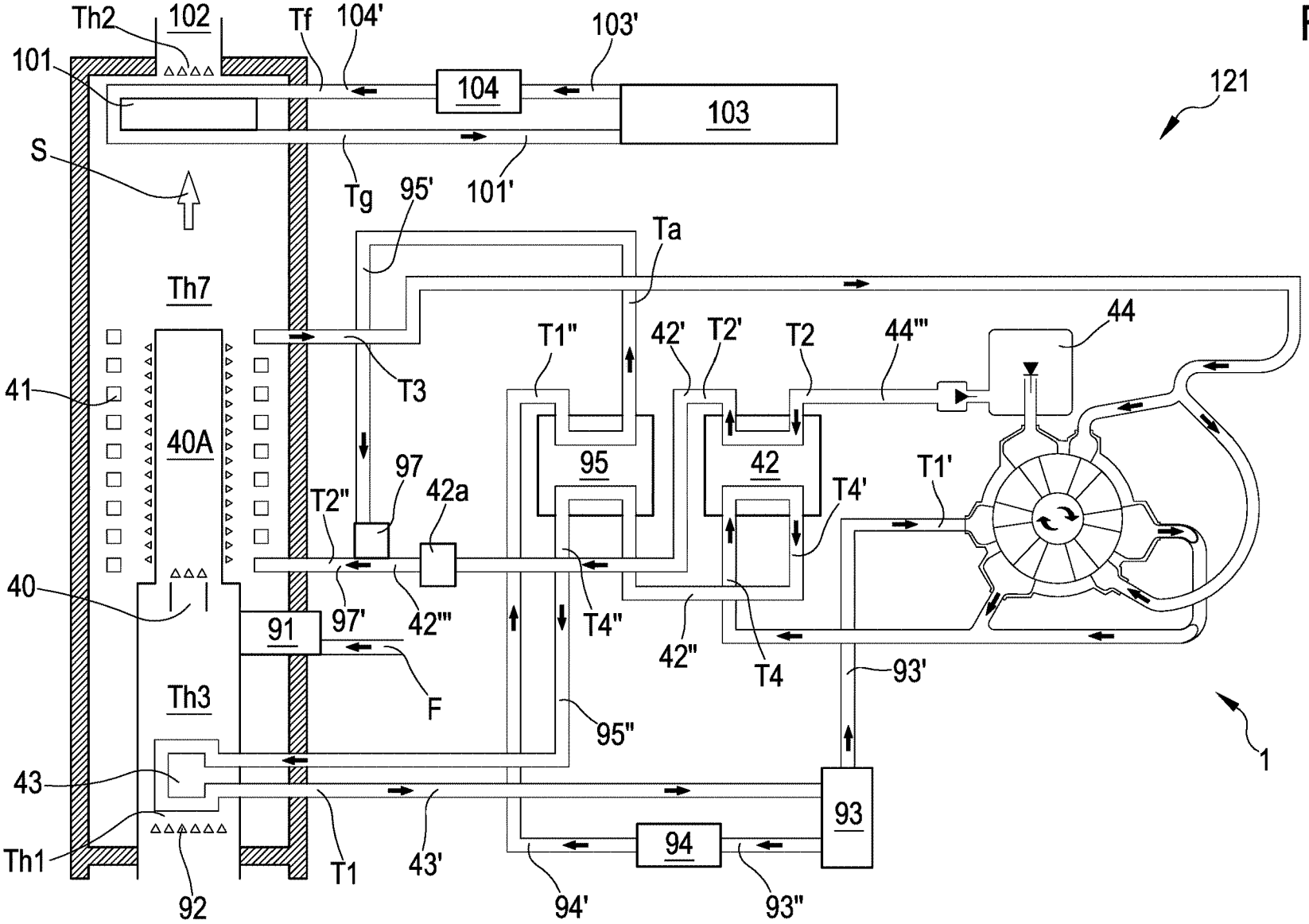
Figure 9:
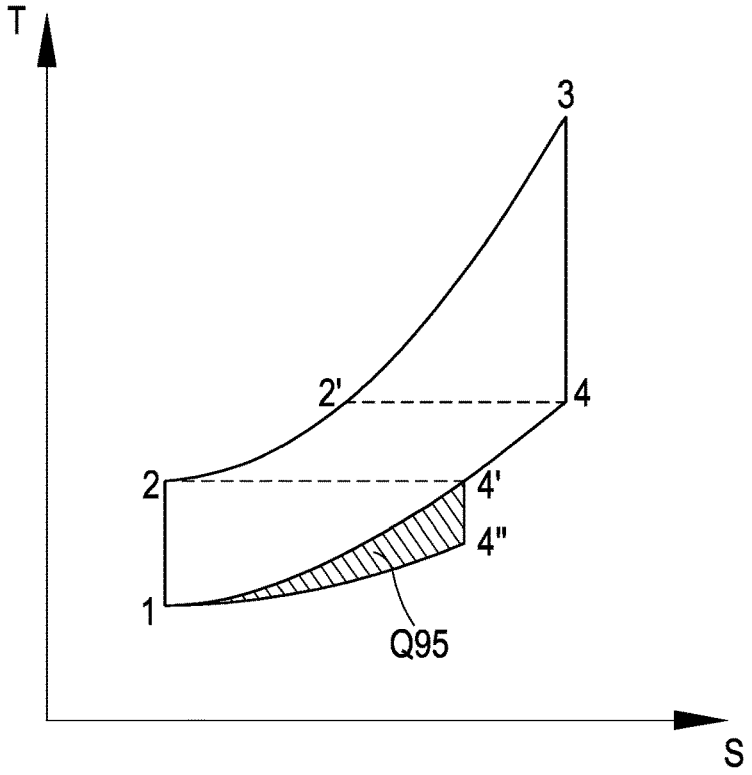
Figure 10:
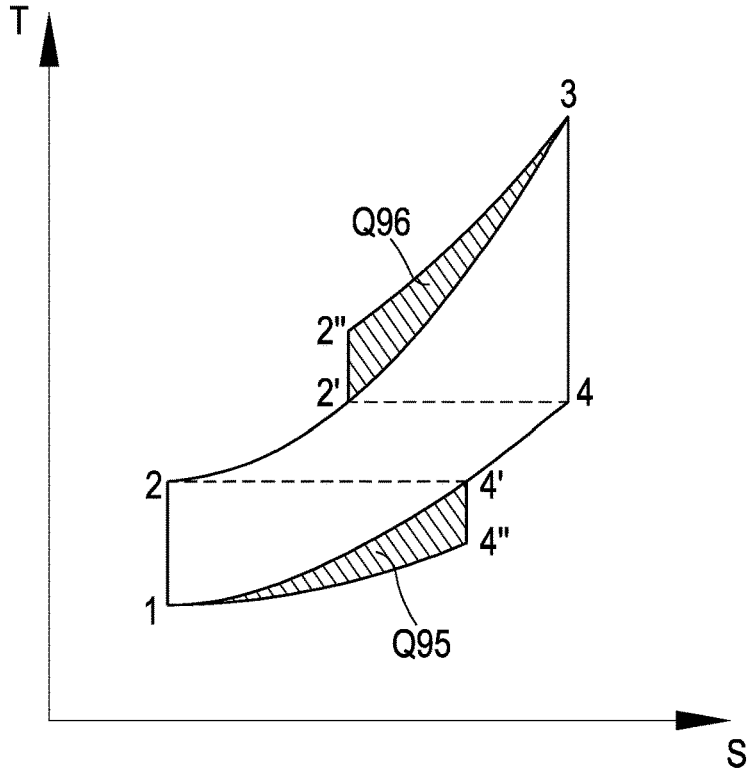
Figure 11:
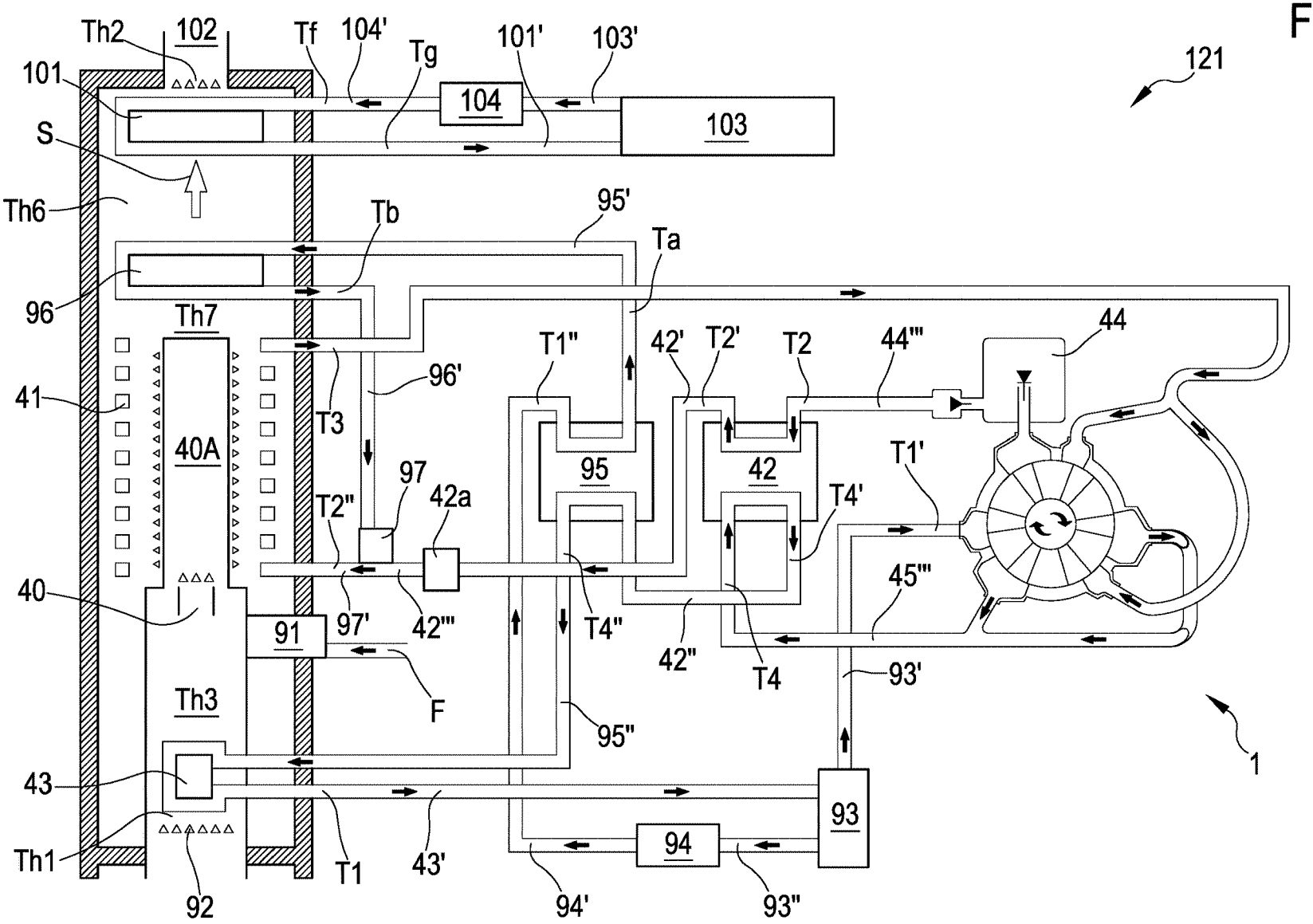
Figure 12:
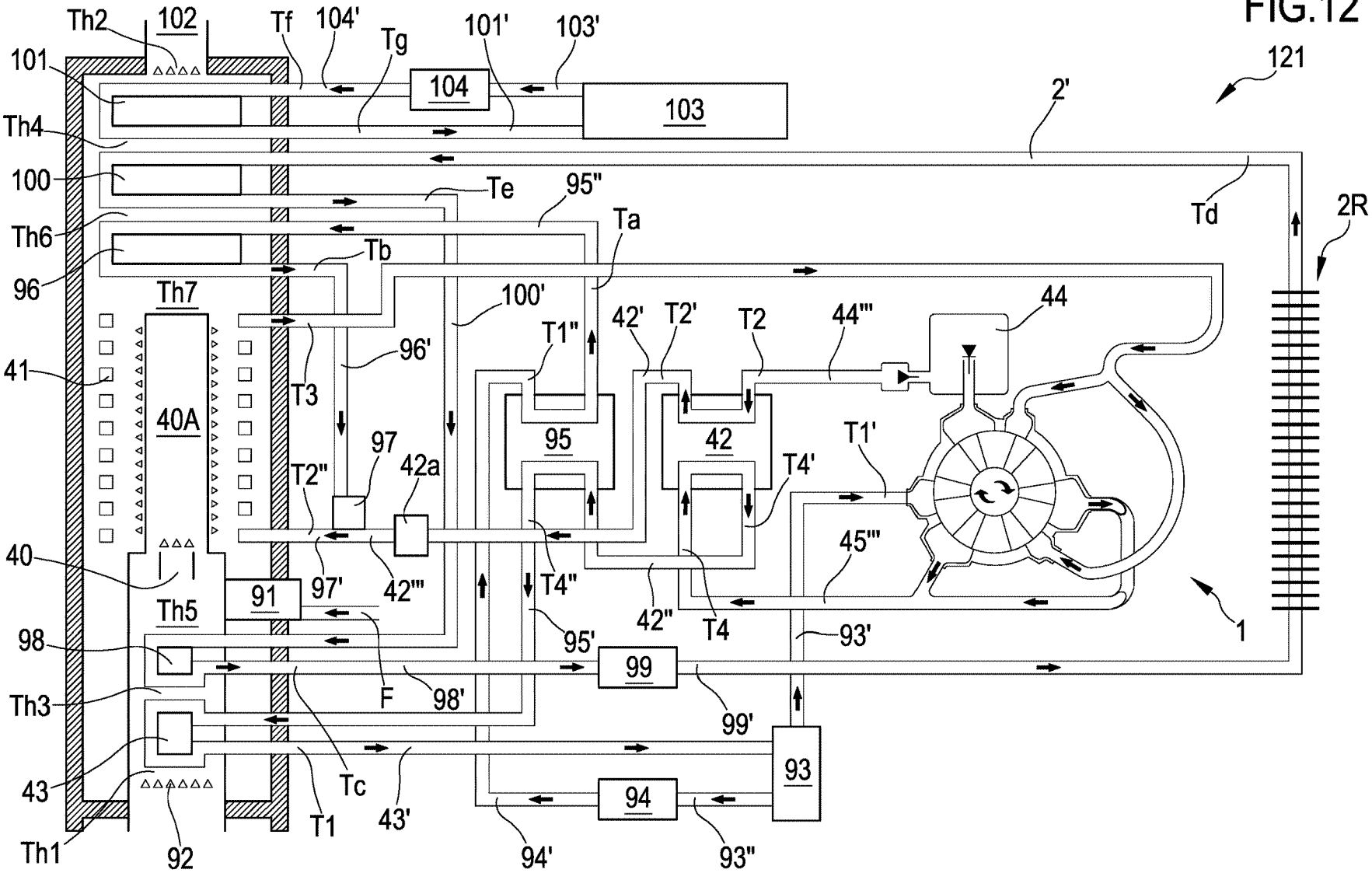
Figure 13:
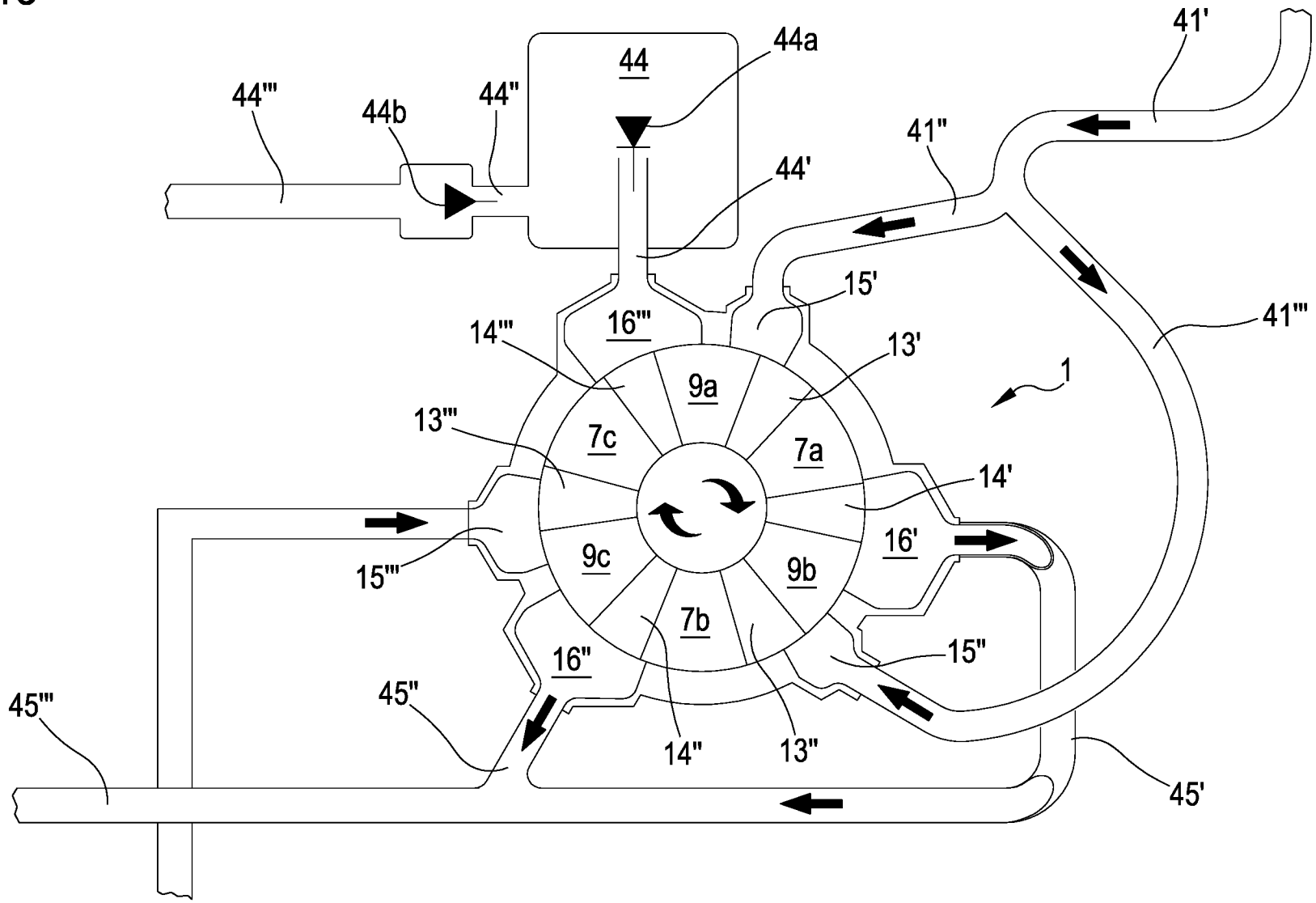

FIG. 6 schematically illustrates a first possible embodiment of a heat machine according to the present invention in an "open-circuit" configuration characterized by the use of a thermal fluid composed of air with the injection of water;

FIG. 7 schematically illustrates a second possible embodiment of a heat machine according to the present invention, in a "closed-circuit" configuration, characterized by the use of a thermal fluid composed of air with the injection of condensate of aqueous vapour;

FIG. 8 schematically illustrates a third possible embodiment of a heat machine according to the present invention, in a "closed-circuit" configuration, characterized by the use of a thermal fluid composed of air with the injection of saturated aqueous vapour;

FIG. 9 illustrates a functional diagram that shows the energy recovery obtainable through the vaporization of condensed water;

FIG. 10 illustrates a functional diagram that shows the increase in energy obtainable through the vaporization of condensed water and with the use of superheated aqueous vapour in the cycle;

FIG. 11 schematically illustrates a fourth possible embodiment of a heat machine according to the present invention, in a "closed-circuit" configuration, characterized by the use of a thermal fluid composed of air with the injection of superheated aqueous vapour;

FIG. 12 schematically illustrates a fifth possible embodiment of a heat machine according to the present invention, in a "closed-circuit" configuration, characterized by the use of a thermal fluid composed of air with the injection of superheated aqueous vapour and provided with an energy recovery system with thermal stabilization of the drive unit;

FIG. 13 shows an enlargement of a portion of the heat machine according to the present invention; this portion is identical for the configurations shown in FIGS. 6, 7, 8, 11 and 12.

DETAILED DESCRIPTION OF THE DRIVE UNIT EMPLOYED IN THE HEAT MACHINE

With reference to FIGS. 1, 2*a*, 2*b*, 3, (1) denotes in its entirety the "drive unit" employed as "compressor/expander" in a new "pulsating heat cycle" operating preferably with hot air and aqueous vapour.

The drive unit 1 comprises a casing 2 which internally delimits a seat 3.

In the non-limiting embodiment illustrated, the casing 2 is made up of two half-parts 2*a*, 2*b* joined together.

Housed in the seat 3 there is a first rotor 4 and a second rotor 5, which rotate around a same axis "X-X".

The first rotor 4 has a first cylindrical body 6 and three first elements 7*a*, 7*b*, 7*c* which extend radially from the first cylindrical body 6 and are rigidly connected or integral therewith.

The second rotor 5 has a second cylindrical body 8 and three second elements 9*a*, 9*b*, 9*c* which extend radially from the second cylindrical body 8 and are rigidly connected or integral therewith.

The elements 7*a*, 7*b*, 7*c* of the rotor 4 are angularly equidistant from one another, i.e. each element is spaced apart from the adjacent element on average by an angle "a" of 120° (measured between the planes of symmetry of each element).

The elements 9*a*, 9*b*, 9*c* of the rotor 5 are angularly equidistant from one another, i.e. each element is spaced apart from the adjacent element on average by an angle "a" of 120° (measured between the planes of symmetry of each element).

The first and second cylindrical bodies 6, 8 are set side by side at respective bases 10, 11 and are coaxial.

The three first elements 7*a*, 7*b*, 7*c* of the first rotor 4 moreover extend along an axial direction and have a projecting portion disposed in a position that is radially external to the second cylindrical body 8 of the second rotor 5.

The three second elements 9*a*, 9*b*, 9*c* of the second rotor 5 moreover extend along an axial direction and have a projecting portion disposed in a position that is radially external to the first cylindrical body 6 of the first rotor 4.

The three first elements 7*a*, 7*b*, 7*c* are alternated with the three second elements 9*a*, 9*b*, 9*c* along the circumferential extent of the annular chamber 12.

Each of the first and second elements 7*a*, 7*b*, 7*c*, 9*a*, 9*b*, 9*c* has, in a radial section (FIG. 1), a substantially trapezoidal profile which converges toward the rotation axis "X-X" and, in a axial section (FIG. 2*a*,2*b*), a substantially circular or rectangular profile.

Each of the first and second elements 7*a*, 7*b*, 7*c*, 9*a*, 9*b*, 9*c* has an angular size, given purely by way of approximation and not by way of limitation, of about 38°.

Peripheral surfaces that are radially external to the first and second cylindrical bodies 6, 8 delimit, together with an inner surface of the seat 3, an annular chamber 12.

The annular chamber 12 is therefore divided into variable-volume "rotating chambers" 13', 13", 13'", 14', 14", 14'" by the first and second elements 7*a*, 7*b*, 7*c*, 9*a*, 9*b*, 9*c*. In particular, each variable-volume "rotating chamber" is delimited (besides by the surface radially internal to the casing 2 and the surface radially external to the cylindrical bodies 6, 8) by one of the first elements 7*a*, 7*b*, 7*c* and one of the second elements 9*a*, 9*b*, 9*c*.

Figure 2A:
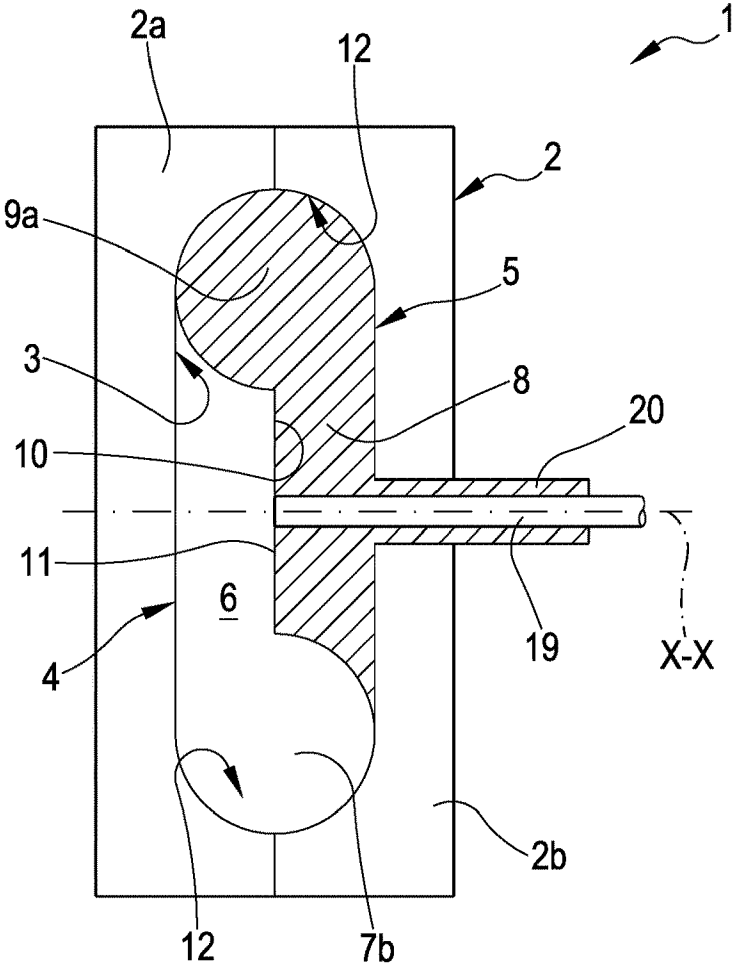
Figure 1:
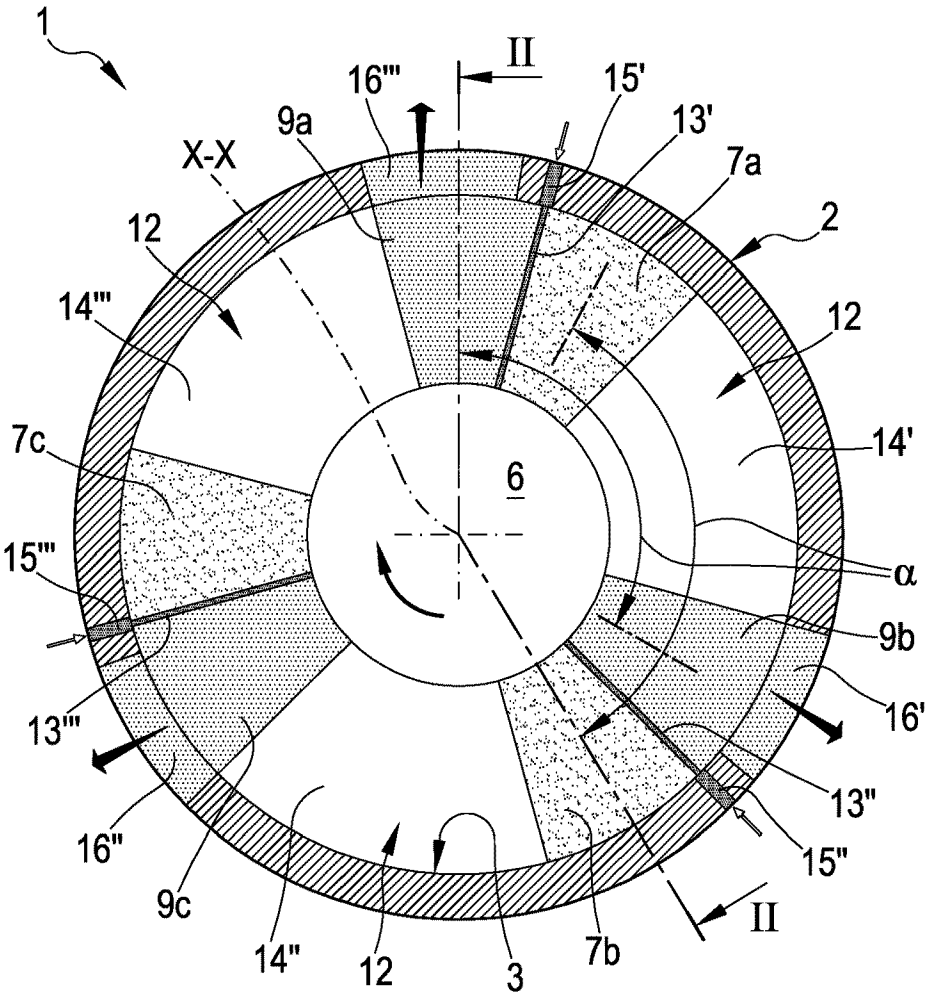
Figure 3:
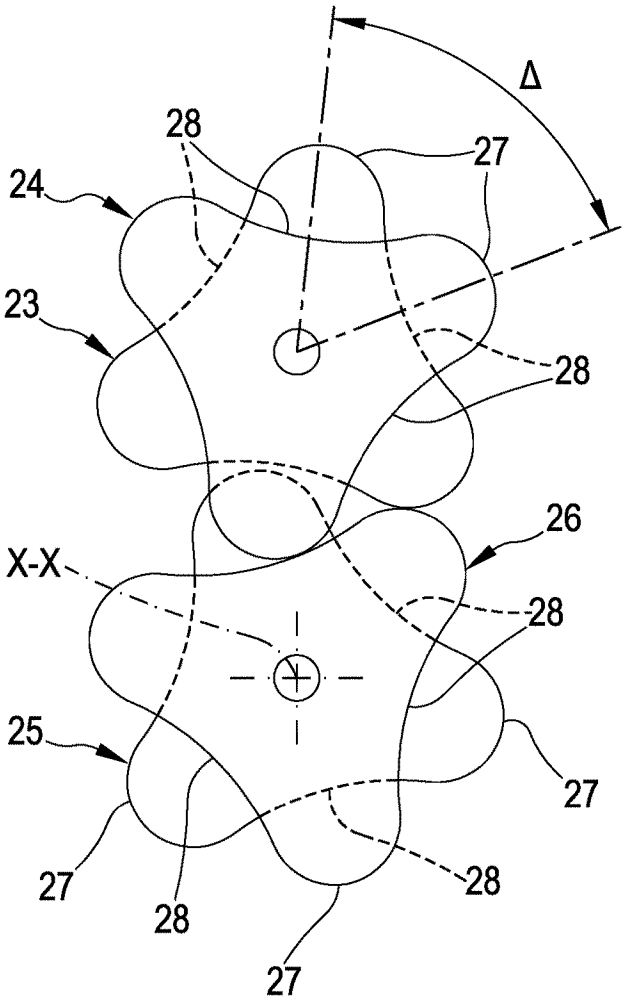
FIG. 3 illustrates a front view of the train of three-lobe gears forming part of the motion transmission system of the drive unit of FIG. 1.

In the first FIG. 2*a*, each of the first and second elements 7*a*, 7*b*, 7*c*, 9*a*, 9*b*, 9*c* has, in an axial section thereof, a substantially circular profile and the annular chamber 12 likewise has a circular cross section defined as "toroidal".

Figure 2B:
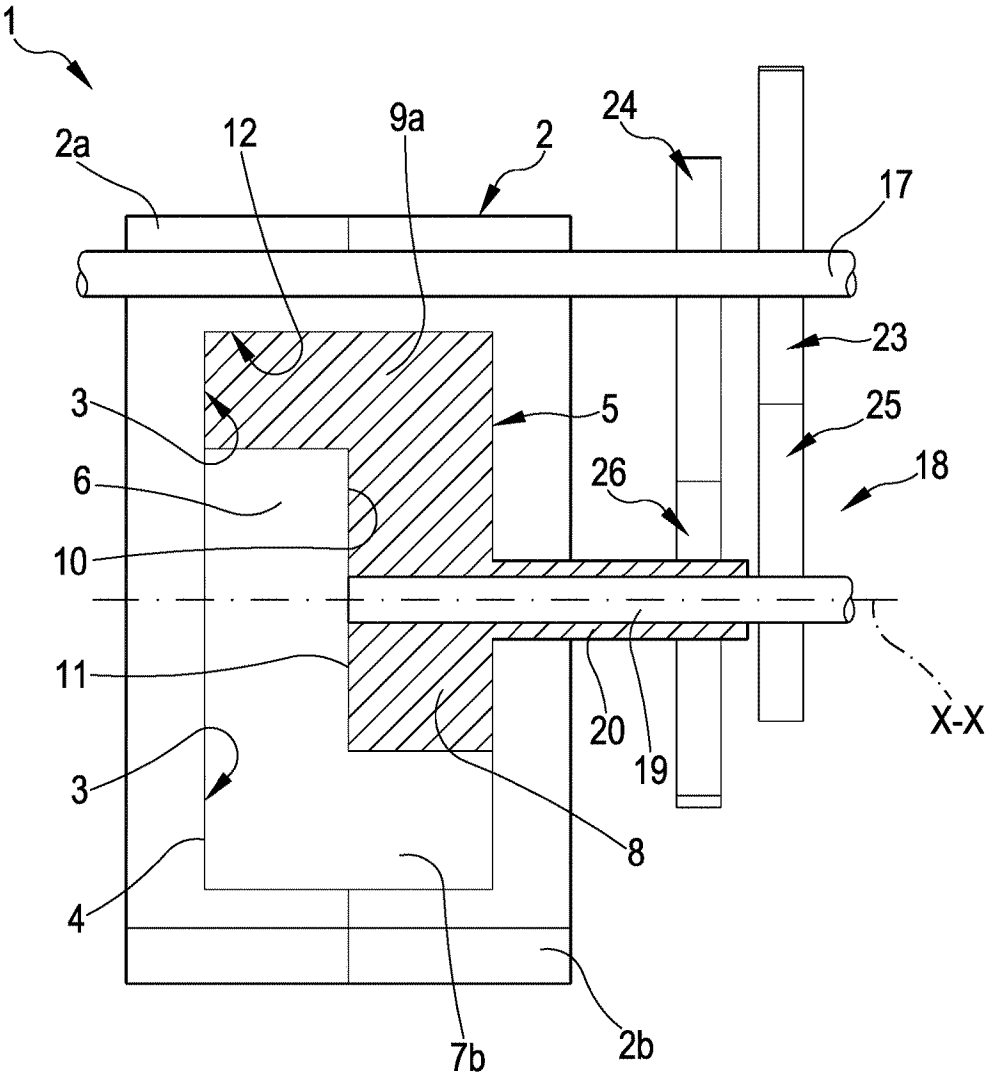
Figure 4:
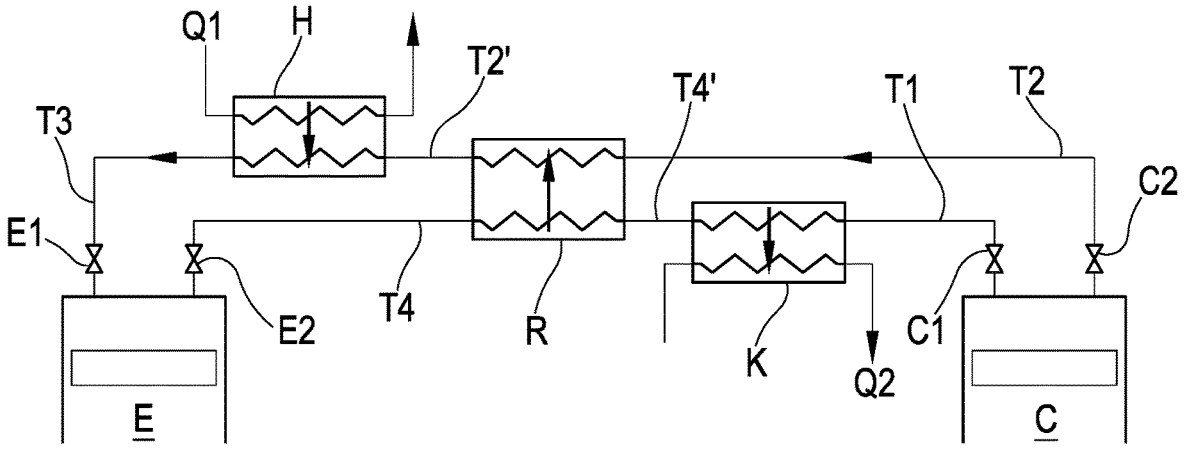
FIG. 4 illustrates the operating diagram of the closed-circuit Ericsson cycle carried out with an engine provided with pistons with reciprocating motion.
Figure 5:
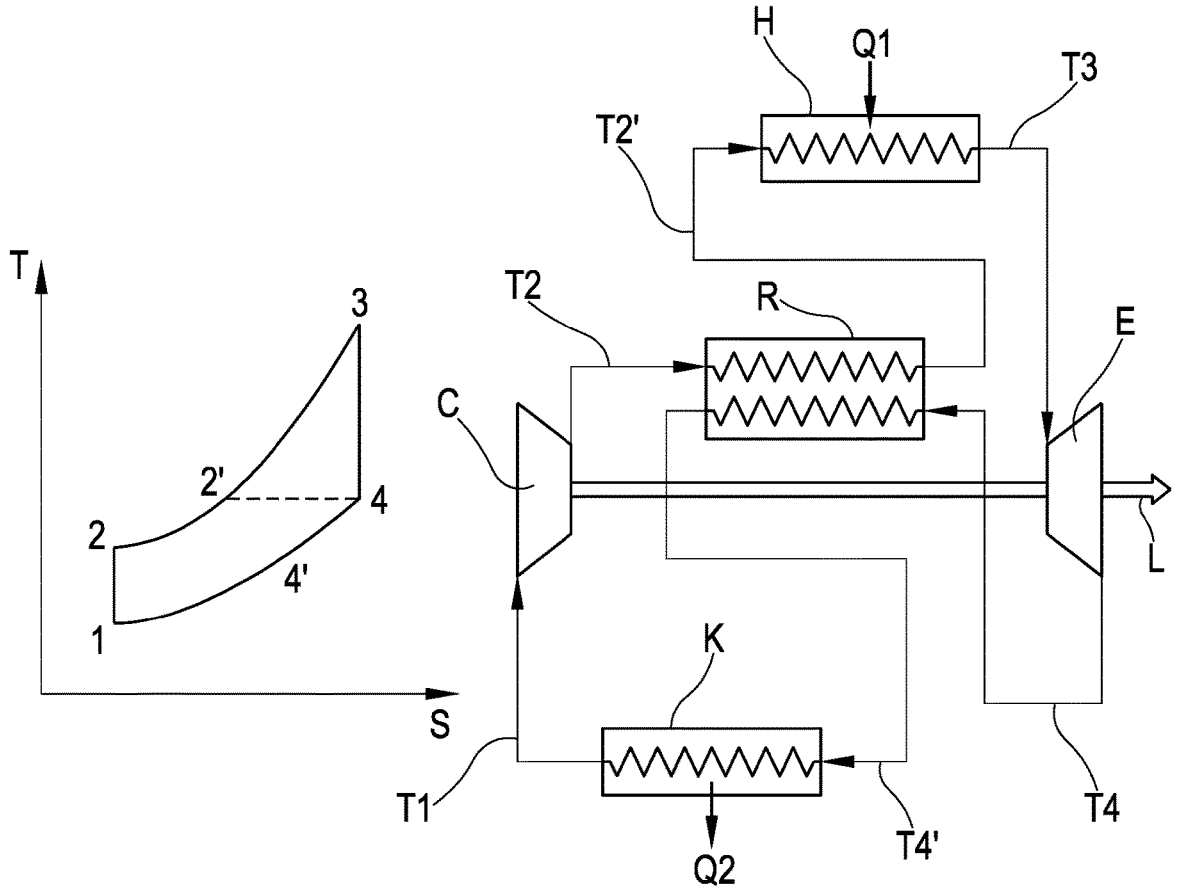
FIG. 5 illustrates the operating diagram of a heat machine with a closed-circuit Joule cycle carried out with a single-shaft turbine.

In the variant in FIG. 2*b*, each of the first and second elements 7*a*, 7*b*, 7*c*, 9*a*, 9*b*, 9*c* has, in a axial section thereof, a rectangular (or square) profile and the annular chamber 12 likewise has a rectangular (or square) cross section.

Between inner walls of the annular chamber 12 and each of the aforesaid first and second elements 7*a*, 7*b*, 7*c*, 9*a*, 9*b*, 9*c* there remains an interspace such as to permit the rotary movement of the pistons 4, 5 and sliding of the elements 7*a*, 7*b*, 7*c*, 9*a*, 9*b*, 9*c* in the chamber 12 itself.

The first and second elements 7*a*, 7*b*, 7*c*, 9*a*, 9*b*, 9*c* are the pistons of the drive unit 1 illustrated and the variable-volume rotating chambers 13', 13", 13'", 14', 14", 14'" are the chambers for the compression and/or expansion of the working fluid of said drive unit 1.

The inlet or discharge openings 15', 16', 15", 16", 15'", 16'" (of suitable size and shape) are fashioned in a wall radially external to the casing 2; they open into the annular chamber 12 and are in fluid communication with conduits external to the annular chamber 12, illustrated further below.

Each inlet or discharge opening 15', 16', 15", 16", 15'", 16'" is angularly spaced in an appropriate way so as to adapt to the requirements of each different individual functional configuration of the drive unit 1.

The drive unit 1 further comprises a primary shaft 17 parallel to and distanced from the rotation axis "X-X" and rotatably mounted on the casing 2 and a transmission 18 mechanically interposed between the primary shaft 17 and the rotors 4, 5.

The transmission 18 comprises a first auxiliary shaft 19 onto which the first rotor 4 is keyed and a second auxiliary shaft 20 onto which the second rotor 5 is keyed. The first and second auxiliary shafts 19, 20 are coaxial with the rotation axis "X-X". The second auxiliary shaft 20 is tubular and houses within it a portion of the first auxiliary shaft 19. The first auxiliary shaft 19 can rotate in the second auxiliary shaft 20 and the second auxiliary shaft 20 can rotate in the casing 2.

A first three-lobe gear 23 is keyed onto the primary shaft 17. A second three-lobe gear 24 is keyed onto the primary shaft 17 next to the first. The second three-lobe gear 24 is mounted on the primary shaft 17 angularly offset relative to the first three-lobe gear 23 by an angle "A" of 60°. The two three-lobe gears 23 and 24 rotate together jointly with the primary shaft 17.

A third three-lobe gear 25 is keyed onto the first auxiliary shaft 19 (so as to rotate integrally therewith) and the teeth thereof precisely enmesh with the teeth of the first three-lobe gear 23.

A fourth three-lobe gear 26 is keyed onto the second auxiliary shaft 20 (so as to rotate integrally therewith) and the teeth thereof precisely enmesh with the teeth of the second three-lobe gear 24.

Each of the above-mentioned three-lobe gears 23, 24, 25, 26 has approximately the profile of an equilateral triangle with rounded vertices 27 and connecting portions 28, interposed between the vertices 27, which can be concave, flat or convex.

Changing the shape of the vertices 27 and connecting portions 28 of the gears makes it possible to pre-establish the value of the angular periodic movement of the auxiliary shafts 19, 20 during their rotary motion.

The structure of the transmission 18 is such that during a complete revolution of the primary shaft 17 the two rotors 4, 5 also carry out a complete revolution, but with periodically variable angular velocities, offset from each other, which induce the adjacent pistons 7*a*, 9*a*; 7*b*, 9*b*; 7*c*, 9*c* to move away and toward one another three times during a complete 360° revolution. Therefore, each of the six variable-volume chambers 13', 13", 13'", 14', 14", 14'" expands three times and contracts three times at each complete revolution of the primary shaft 17.

In others words, pairs of adjacent pistons of the six pistons 7*a*, 7*b*, 7*c*; 9*a*, 9*b*, 9*c* are movable, during their rotation at a periodically variable angular velocity in the annular chamber 12, between a first position, in which the two faces of the adjacent pistons lie substantially next to each other, and a second position, in which the same faces are angularly spaced apart by the maximum allowed. Purely by way of example, in the first position the two faces of the adjacent pistons are angularly spaced apart from each other by about 1°, whereas in the second position the two same faces are angularly spaced apart from each other by about 81°.

The six variable-volume chambers 13', 13", 13'", 14', 14", 14'" are made up of a first group of three chambers 13', 13", 13'" and a second group of three chambers 14', 14", 14'". When the three chambers 13', 13", 13'" of the first group have the minimum volume (pistons next to each other at the minimum reciprocal distance) the other three chambers 14', 14", 14'" (of the second group) have the maximum volume (pistons at the maximum reciprocal distance).

For the purpose of better clarifying and highlighting the innovative aspects of the present invention, the five main functional configurations will be described below in a precise and detailed manner.

In order to describe the operation of the new heat machine (121), configured to operate with a "pulsating heat cycle" according to the present invention, it is necessary to start off by noting that in the drive unit (1), in each of the six periodically variable-volume chambers (13',13",13'",14', 14",14'"), each delimited by the two pistons adjacent to each other and rotating inside the annular cylinder, the diversified suction, compression, expansion and expulsion functions are performed periodically.

FIG. 13 shows an enlargement of a portion of the heat machine according to the present invention; this portion relates to the drive unit employed, identically, in the five configurations that are shown in FIGS. 6, 7, 8, 11 and 12, and are the subject matter of the following five descriptions (A, B, C, D, E). The reference numbers included in FIG. 13, used to identify elements of the drive unit 1 and its connection to the components of the heat machine 121, are applicable to the corresponding elements shown in FIGS. 6, 7, 8, 11 and 12.

For the sake of simplicity, in the following five descriptions (A, B, C, D, E), the path followed by the thermal fluid in the different sections of the heat engine (121) will be explained as if a single complete heat cycle were involved. In reality, for each revolution of the drive shaft (corresponding to a revolution angle of) 360° no fewer than six complete heat cycles are carried out.

A. Detailed Description of the Heat Machine 121 Operating According to the Functional Configuration Represented in the FIG. 6.

Compared to the Joule-Ericsson cycles on their own and the sole "drive unit", the novelty introduced with this configuration regards the realization of a "combined" operating cycle, where the thermal fluid is a mixture of air and water (transformed into vapour); this ensures the lubrication of the cylinder (where the pistons slide) and enables a higher unit power to be obtained, albeit with a slight decrease in overall efficiency.

With reference to FIG. 6, in the position where the pistons are located, the following main steps of the cycle can be identified:

A1_Setting into Motion.

Noting first of all that all control and regulating devices are powered via a specific auxiliary electric line (not represented), the start-up of the heat machine 121 takes place in the following manner:

- the primary shaft 17 (visible in FIG. 2*b*) and the whole transmission system that moves the six pistons 7*a*,7*b*, 7*c*,9*a*,9*b*,9*c* are set in rotation via the starter motor, thus creating the preliminary condition for start-up of the cycle;
- the metering pump for metering distilled water 97*b* is activated;
- the fan 92 is activated;
- the burner is activated by acting on the regulation valve 91 (which controls the injection of fuel F) 40 and the combustion process is started;
- when the circulating thermal fluid has reached the predetermined minimum operating condition, the drive unit 1 will be capable of producing the work necessary in order to be able to run autonomously.

A2_Start of the Cycle, Starting from the Step of Suctioning Ambient Air.

The air suctioned from the environment at temperature T1', passes into the pipe 93, passes through the suctioning opening 15'" and, following the movement of the two pistons 9*c*-7*c* away from each other, it is suctioned into the chamber 13'".

A3_Step of Compression and Recovery of the Suctioned Air.

Following the movement of the two pistons 7*c*-9*a* towards each other, the previously suctioned air is compressed in the chamber 14'" (up to the limit, which is normally preset with a minimum ratio of 1:4 and a maximum ratio of 1:20), undergoes an increase in temperature from T1' to T2, passes through the discharge opening 16'", the pipe 44' and the check valve 44*a* and ends up in the compensation tank 44, where it remains available for immediate use.

A4_Step of Preheating the Compressed Thermal Fluid.

With the intermittency determined by the rotation of the pistons and the resulting opening/closing of the inlet openings 15,15", the air flows out from the tank 44, passes through the pipe 44" and the check valve 44*b*, travels through the pipe 44", and passes into the regenerator 42 (where it undergoes an increase in temperature from T2 to T2').

A5_Step of Injecting Distilled Water into the Air Conduit.

The air, exiting from the regenerator 42, travels through the pipe 42', passes through the check valve 42*a* and passes into the pipe 42'".

The distilled water is drawn from the tank 97*a*, travels through the pipe 97", is brought to a high pressure in the metering pump 97*b* and, at temperature Tc, is conveyed into the pipe 97'" and, by means of the injector 97, it is introduced into the pipe 42'" where, as a result of mixing, the mixture thus formed undergoes a decrease in temperature from T2' to T2".

A6_Step of Superheating the Circulating Thermal Fluid.

The mixed thermal fluid travels through the pipe 97', passes through the heater 41 (adjacent to the combustion chamber 40A and provided with the multi-fuel burner 40), where it receives heat-energy and increases in temperature from T2" to T3.

A7_Step of Expanding the Superheated Thermal Fluid and Producing Useful Work.

When the pistons 7*a*-7*b*, by rotating in the annular cylinder in the direction of motion indicated by the arrows, open the inlet openings 15-15", the superheated thermal fluid flowing through the pipes 41'-41"-41'" is introduced into the expansion chambers 13' and 13", where it is expanded (decreasing in temperature from T3 to T4) and, by making the pistons rotate, produces useful work.

A8_Step of Expulsion and of Recovering Energy from the Exhausted Thermal Fluid.

Following the movement of the pistons 7*a*-9*b* and 7*b*-9*c* towards each other, the chambers 14' and 14" diminish in volume, the exhausted thermal fluid (already expanded in the previous cycle) is expelled from the drive unit 1, passes through the two discharge openings 16'-16", flows through the pipes 45'-45"-45", passes through the regenerator 42 (where it surrenders part of the energy-heat still possessed and undergoes a decrease in temperature from T4 to T4') and then, on passing through the pipe 42", is discharged into the atmosphere, the heat cycle thus being concluded.

A9_Recovery of Energy with a Reduction in the Temperature of the Combustion Fumes.

Given that the function envisaged for the heat machine is also to provide energy-heat to be destined to auxiliary uses (space heating and/or production of domestic hot water, etc.), before the hot fumes are discharged into the atmosphere (through the conduit 102), all their residual energy is recovered by reducing their temperature as much as possible (it also being possible to recover further energy through their possible condensation). To achieve this purpose, use is made of a specific hydraulic circuit, where the following mode of conveyance is adopted: the incoming thermal fluid (normally water) from the auxiliary uses 103 passes into the pipe 103' and, pushed by the circulation pump 104, passes into the pipe 104', reaches the recuperator 101 at the low temperature Tf and then, on passing through it, thanks to the reduction in the temperature of the fumes S from Th7 to Th2, acquires energy-heat and heats up to the higher temperature Tg, so as to be made available, via the pipe 101', for the auxiliary uses 130, and for the intended purpose.

B. Detailed Description of the Heat Machine 121 Operating According to the Functional Configuration Represented in FIG. 7.

Compared to the Joule-Ericsson cycles on their own and the sole "drive unit", the novelty introduced with this configuration regards the realization of a "combined" operating cycle, where the thermal fluid is a mixture of air and water (transformed into vapour); this ensures the lubrication of the cylinder (where the pistons slide) and enables a higher unit power to be obtained, albeit with a slight decrease in overall efficiency.

With reference to FIG. 7, in the position where the pistons are located, the following main steps of the cycle can be identified:

B1_Setting into Motion the Heat Machine 121.

Noting first of all that all control and regulating devices are powered via a specific auxiliary electric line (not represented), the start-up of the heat machine 121 takes place in the following manner:

- the primary shaft 17 (visible in FIG. 2*b*) and the whole transmission system that moves the six pistons 7*a*,7*b*, 7*c*,9*a*,9*b*,9*c* are set in rotation via the starter motor, thus creating the preliminary condition for start-up of the cycle;
- the condensate water pump 94 is activated;
- the fan 92 is activated;
- the burner 40 is activated by acting on the regulation valve 91 (which controls the injection of fuel F) and the combustion process is started;
- when the circulating thermal fluid has reached the predetermined minimum operating condition, the drive unit 1 will be capable of producing the work necessary in order to be able to run autonomously.

B2_Start of the Cycle, Starting from the Step of Suctioning the Cooled Thermal Fluid.

The thermal fluid, exiting from the cooler 43 at temperature T1, passes into the pipe 43', passes through the condensate trap 93 (where the water in the thermal fluid is condensed and separated from the air), passes into the pipe 93' at temperature T1', passes through the suctioning opening 15''' and, following the movement of the two pistons 9*c*-7*c* away from each other, is suctioned into the chamber 13'''.

B3_Step of Compression and Recovery of the Suctioned Thermal Fluid.

Following the movement of the two pistons 7*c*-9*a* towards each other, the previously suctioned air is compressed in the chamber 14' (up to the limit, which is normally preset with a minimum ratio of 1:4 and a maximum ratio of 1:20), undergoes an increase in temperature from T1' to T2, passes through the discharge opening 16''', the pipe 44' and the check valve 44*a* and ends up in the compensation tank 44, where it remains available for immediate use.

B4_Step of Preheating the Compressed Thermal Fluid.

With the intermittency determined by the rotation of the pistons and the resulting opening/closing of the inlet openings 15,15", the air flows out from the tank 44, passes through the pipe 44" and the check valve 44*b*, travels through the pipe 44", and passes into the regenerator 42 (where it undergoes an increase in temperature from T2 to T2').

B5_Step of Drawing Condensate Water.

Pushed by the high pressure pump 94, the condensate water previously extracted from the air by the trap 93, flows through the pipes 93" and 94' (at temperature T1").

B6_Step of Injecting the Condensate Water into the Air Conduit.

The air, exiting from the regenerator 42, travels through the pipe 42', passes through the check valve 42*a* and passes into the pipe 42''' where, via the injector 97, the condensate water is introduced. As a result of the mixing of the air with the condensate water, the mixture undergoes a decrease in temperature from T2' to T2".

B7_Step of Superheating the Circulating Thermal Fluid.

The mixed thermal fluid travels through the pipe 97', passes through the heater 41 (adjacent to the combustion chamber 40A and provided with the multi-fuel burner 40), where it receives heat-energy and increases in temperature from T2" to T3.

B8_Step of Expanding the Superheated Thermal Fluid and Producing Useful Work.

When the pistons 7*a*-7*b*, by rotating in the annular cylinder in the direction of motion indicated by the arrows, open the inlet openings 15-15", the superheated thermal fluid flowing through the pipes 41'-41"-41''' is introduced into the expansion chambers 13' and 13", where it is expanded (decreasing in temperature from T3 to T4) and, by making the pistons rotate, produces useful work.

B9_Step of Expulsion and of Recovering Energy from the Exhausted Thermal Fluid.

Following the movement of the pistons 7*a*-9*b* and 7*b*-9*c* towards each other, the chambers 14' and 14" diminish in volume, the exhausted thermal fluid (already expanded in the previous cycle) is expelled from the drive unit 1, passes through the two discharge openings 16'-16", flows through the pipes 45'-45"-45''', passes through the regenerator 42 (where it surrenders part of the energy-heat still possessed and undergoes a first decrease in temperature from T4 to T4').

B10_Conclusion of the Cycle with Further Cooling of the Exhausted Thermal Fluid.

The thermal fluid passes into the pipe 42" and reaches the cooler 43, from where the cycle can continue and repeat itself in a continuous mode.

B11_Recovery of Energy with the Optimization of the Process of Preheating the Combustion Air.

The combustion air drawn from the environment is pushed by the fan 92 and passes into the cooler 43, where it acquires energy and increases in temperature from Th1 to Th3, thus facilitating the combustion process.

B12_Recovery of Energy with a Reduction in the Temperature of the Combustion Fumes.

Given that the function envisaged for the heat machine is also to provide energy-heat to be destined to auxiliary uses (space heating and/or production of domestic hot water, etc.), before the hot fumes are discharged into the atmosphere (through the conduit 102), all their residual energy is recovered by reducing their temperature as much as possible (it also being possible to recover further energy through their possible condensation). To achieve this purpose, use is made of a specific hydraulic circuit, where the following mode of conveyance is adopted: the incoming thermal fluid (normally water) from the auxiliary uses 103 passes into the pipe 103' and, pushed by the circulation pump 104, passes into the pipe 104', reaches the recuperator 101 at the low temperature Tf and then, on passing through it, thanks to the reduction in the temperature of the fumes S from Th7 to Th2, acquires energy-heat and heats up to the higher temperature Tg, so as to be made available, via the pipe 101', for the auxiliary uses 130, and for the intended purpose.

C. Detailed Description of the Heat Machine 121 Operating According to the Functional Configuration Represented in FIG. 8.

Compared to the Joule-Ericsson cycles on their own and the sole "drive unit", the novelty introduced with this configuration regards the realization of a "combined" operating cycle, where the thermal fluid is a mixture of air and water (transformed into vapour); this ensures the lubrication of the cylinder (where the pistons slide) and enables a higher unit power to be obtained and an improvement in the overall efficiency.

With reference to FIG. 8, in the position where the pistons are located, the following main steps of the cycle can be identified:

C1_Setting into Motion the Heat Machine 121.

Noting first of all that all control and regulating devices are powered via a specific auxiliary electric line (not represented), the start-up of the heat machine 121 takes place in the following manner:

- the primary shaft 17 (visible in FIG. 2*b*) and the whole transmission system that moves the six pistons 7*a*,7*b*, 7*c*,9*a*,9*b*,9*c* are set in rotation via the starter motor, thus creating the preliminary condition for start-up of the cycle;
- the condensate water pump 94 is activated;
- the fan 92 is activated;
- the burner 40 is activated by acting on the regulation valve 91 (which controls the injection of fuel F) and the combustion process is started;
- when the circulating thermal fluid has reached the predetermined minimum operating condition, the drive unit 1 will be capable of producing the work necessary in order to be able to run autonomously.

C2_Start of the Cycle, Starting from the Step of Suctioning the Cooled Thermal Fluid.

The thermal fluid, exiting from the cooler 43 at temperature T1, passes into the pipe 43', passes through the condensate trap 93 (where the water in the thermal fluid is condensed and separated from the air), passes into the pipe 93' at temperature T1', passes through the suctioning opening 15''' and, following the movement of the two pistons 9*c*-7*c* away from each other, is suctioned into the chamber 13'''.

C3_Step of Compression and Recovery of the Suctioned Thermal Fluid.

Following the movement of the two pistons 7*c*-9*a* towards each other, the previously suctioned air is compressed in the chamber 14' (up to the limit, which is normally preset with a minimum ratio of 1:4 and a maximum ratio of 1:20), undergoes an increase in temperature from T1' to T2, passes through the discharge opening 16''', the pipe 44' and the check valve 44*a* and ends up in the compensation tank 44, where it remains available for immediate use.

C4_Step of Preheating the Compressed Thermal Fluid.

With the intermittency determined by the rotation of the pistons and the resulting opening/closing of the inlet openings 15,15", the air flows out from the tank 44, passes through the pipe 44" and the check valve 44*b*, travels through the pipe 44', and passes into the regenerator 42 (where it undergoes an increase in temperature from T2 to T2').

C5_Step of Vaporizing/Superheating the Condensate Water.

Pushed by the high pressure pump 94, the condensate water previously extracted from the air by the trap 93, flows through the pipes 93" and 94', passes through the evaporator 95, where it is heated/vaporized (changing in state from a liquid to a vapour, with an increase in temperature from T1" to Ta).

C6_Step of Injecting the Saturated Vapour into the Air Conduit.

The air, exiting from the regenerator 42, travels through the pipe 42', passes through the check valve 42*a* and passes into the pipe 42' where, via the injector 97, the saturated vapour conveyed in the pipe 95' is introduced. As a result of the mixing of the air with the saturated vapour, the thermal fluid undergoes an increase in mass and decrease in temperature from T2' to T2".

C7_Step of Superheating the Circulating Thermal Fluid.

The mixed thermal fluid travels through the pipe 97', passes through the heater 41 (adjacent to the combustion chamber 40A and provided with the multi-fuel burner 40), where it receives heat-energy and increases in temperature from T2" to T3.

C8_Step of Expanding the Superheated Thermal Fluid and Producing Useful Work.

When the pistons 7*a*-7*b*, by rotating in the annular cylinder in the direction of motion indicated by the arrows, open the inlet openings 15-15", the superheated thermal fluid flowing through the pipes 41'-41"-41''' is introduced into the expansion chambers 13' and 13", where it is expanded (decreasing in temperature from T3 to T4) and, by making the pistons rotate, produces useful work.

C9_Step of Expulsion and of Recovering Energy from the Exhausted Thermal Fluid.

Following the movement of the pistons 7*a*-9*b* and 7*b*-9*c* towards each other, the chambers 14' and 14" diminish in volume, the exhausted thermal fluid (already expanded in the previous cycle) is expelled from the drive unit 1, passes through the two discharge openings 16'-16", flows through the pipes 45'-45"-45''', passes through the regenerator 42 (where it surrenders part of the energy-heat still possessed and undergoes a first decrease in temperature from T4 to T4'), then passes into the pipe 42", passes through the evaporator 95, where it again surrenders part of the energy-heat possessed and undergoes a second decrease in temperature from T4' to T4", enabling the recovery of useful energy, which is schematically represented in the area Q95 in FIG. 9.

C10_Conclusion of the Cycle with Further Cooling of the Exhausted Thermal Fluid.

The thermal fluid passes into the pipe 95" and reaches the cooler 43, from where the cycle can continue and repeat itself in a continuous mode.

C11_Recovery of Energy with the Optimization of the Process of Preheating the Combustion Air.

The combustion air drawn from the environment is pushed by the fan 92 and passes into the cooler 43, where it acquires energy and increases in temperature from Th1 to Th3, thus facilitating the combustion process.

C12_Recovery of Energy with a Reduction in the Temperature of the Combustion Fumes.

Given that the function envisaged for the heat machine is also to provide energy-heat to be destined to auxiliary uses (space heating and/or production of domestic hot water, etc.), before the hot fumes are discharged into the atmosphere (through the conduit 102), all their residual energy is recovered by reducing their temperature as much as possible (it also being possible to recover further energy through their possible condensation). To achieve this purpose, use is made of a specific hydraulic circuit, where the following mode of conveyance is adopted: the incoming thermal fluid (normally water) from the auxiliary uses 103 passes into the pipe 103' and, pushed by the circulation pump 104, passes into the pipe 104', reaches the recuperator 101 at the low temperature Tf and then, on passing through it, thanks to the reduction in the temperature of the fumes S from Th7 to Th2, acquires energy-heat and heats up to the higher temperature Tg, so as to be made available, via the pipe 101', for the auxiliary uses 130, and for the intended purpose.

D. Detailed Description of the Heat Machine 121 Operating According to the Functional Configuration Represented in FIG. 11.

Compared to the Joule-Ericsson cycles on their own and the sole "drive unit", the novelty introduced with this configuration regards the realization of a "combined" operating cycle, where the thermal fluid is a mixture of air and water (transformed into superheated vapour); this ensures the lubrication of the cylinder (where the pistons slide) and enables a higher unit power to be obtained and an improvement in the overall efficiency.

With reference to FIG. 11, in the position where the pistons are located, the following main steps of the cycle can be identified:

D1_Setting into Motion the Heat Machine 121.

Noting first of all that all control and regulating devices are powered via a specific auxiliary electric line (not represented), the start-up of the heat machine 121 takes place in the following manner:

- the primary shaft 17 (visible in FIG. 2*b*) and the whole transmission system that moves the six pistons 7*a*,7*b*, 7*c*,9*a*,9*b*,9*c* are set in rotation via the starter motor, thus creating the preliminary condition for start-up of the cycle;
- the condensate water pump 94 is activated;
- the fan 92 is activated;
- the burner 40 is activated by acting on the regulation valve 91 (which controls the injection of fuel F) and the combustion process is started;
- when the circulating thermal fluid has reached the predetermined minimum operating condition, the drive unit 1 will be capable of producing the work necessary in order to be able to run autonomously.

D2_Start of the Cycle, Starting from the Step of Suctioning the Cooled Thermal Fluid.

The thermal fluid, exiting from the cooler 43 at temperature T1, passes into the pipe 43', passes through the condensate trap 93 (where the water in the thermal fluid is condensed and separated from the air), passes into the pipe 93' at temperature T1', passes through the suctioning opening 15''' and, following the movement of the two pistons 9*c*-7*c* away from each other, is suctioned into the chamber 13'''.

D3_Step of Compression and Recovery of the Suctioned Thermal Fluid.

Following the movement of the two pistons 7*c*-9*a* towards each other, the previously suctioned air is compressed in the chamber 14' (up to the limit, which is normally preset with a minimum ratio of 1:4 and a maximum ratio of 1:20), undergoes an increase in temperature from T1' to T2, passes through the discharge opening 16''', the pipe 44' and the check valve 44*a* and ends up in the compensation tank 44, where it remains available for immediate use.

D4_Step of Preheating the Compressed Thermal Fluid.

With the intermittency determined by the rotation of the pistons and the resulting opening/closing of the inlet openings 15',15'', the air flows out from the tank 44, passes through the pipe 44'' and the check valve 44*b*, travels through the pipe 44', and passes into the regenerator 42 (where it undergoes an increase in temperature from T2 to T2').

D5_Step of Vaporizing/Superheating the Condensate Water.

Pushed by the high pressure pump 94, the condensate water previously extracted from the air by the trap 93, flows through the pipes 93'' and 94', passes through the evaporator 95, where it is heated/vaporized (changing in state from a liquid to a vapour, with an increase in temperature from T1'' to Ta), travels through the pipe 95', passes through the superheater 96 (where acquires further energy and increases in temperature from Ta to Tb).

D6_Step of Injecting the Superheated Vapour into the Air Conduit.

The air, exiting from the regenerator 42, travels through the pipe 42', passes through the check valve 42*a* and passes into the pipe 42' where, via the injector 97, the superheated vapour conveyed in the pipe 96' is introduced. As a result of the mixing of the air with the superheated vapour, the thermal fluid undergoes an increase in energy and increases in temperature from T2' to T2'', enabling the recovery of useful energy, which is schematically represented in the area Q96 in FIG. 10.

D7_Step of Superheating the Circulating Thermal Fluid.

The mixed thermal fluid travels through the pipe 97', passes through the heater 41 (adjacent to the combustion chamber 40A and provided with the multi-fuel burner 40), where it receives heat-energy and increases in temperature from T2'' to T3.

D8_Step of Expanding the Superheated Thermal Fluid and Producing Useful Work.

When the pistons 7*a*-7*b*, by rotating in the annular cylinder in the direction of motion indicated by the arrows, open the inlet openings 15'-15'', the superheated thermal fluid flowing through the pipes 41'-41''-41''' is introduced into the expansion chambers 13' and 13'', where it is expanded (decreasing in temperature from T3 to T4) and, by making the pistons rotate, produces useful work.

D9_Step of Expulsion and of Recovering Energy from the Exhausted Thermal Fluid.

Following the movement of the pistons 7*a*-9*b* and 7*b*-9*c* towards each other, the chambers 14' and 14'' diminish in volume, the exhausted thermal fluid (already expanded in the previous cycle) is expelled from the drive unit 1, passes through the two discharge openings 16'-16'', flows through the pipes 45'-45''-45''', passes through the regenerator 42 (where it surrenders part of the energy-heat still possessed and undergoes a first decrease in temperature from T4 to T4'), then passes into the pipe 42'', passes through the evaporator 95, where it again surrenders part of the energy-heat possessed and undergoes a second decrease in temperature from T4' to T4'', enabling the recovery of useful energy, which is schematically represented in the area Q95 in FIG. 10.

D10_Conclusion of the Cycle with Further Cooling of the Exhausted Thermal Fluid.

The thermal fluid passes into the pipe 95'' and reaches the cooler 43, from where the cycle can continue and repeat itself in a continuous mode.

D11_Recovery of Energy with the Optimization of the Process of Preheating the Combustion Air.

The combustion air drawn from the environment is pushed by the fan 92 and passes into the cooler 43, where it acquires energy and increases in temperature from Th1 to Th3, thus facilitating the combustion process.

D12_Recovery of Energy with a Reduction in the Temperature of the Combustion Fumes.

Given that the function envisaged for the heat machine is also to provide energy-heat to be destined to auxiliary uses (space heating and/or production of domestic hot water, etc.), before the hot fumes are discharged into the atmosphere (through the conduit 102), they are first made to pass through the superheater 96 (where their temperature is reduced from Th7 to Th6) and then all their residual energy is recovered by reducing their temperature as much as possible (it also being possible to recover further energy through their possible condensation). To achieve this purpose, use is made of a specific hydraulic circuit, where the following mode of conveyance is adopted: the incoming thermal fluid (normally water) from the auxiliary uses 103 passes into the pipe 103' and, pushed by the circulation pump 104, passes into the pipe 104', reaches the recuperator 101 at the low temperature Tf and then, on passing through it, thanks to the reduction in the temperature of the fumes S from Th6 to Th2, acquires energy-heat and heats up to the higher temperature Tg, so as to be made available, via the pipe 101', for the auxiliary uses 130, and for the intended purpose.

E. Detailed Description of the Heat Machine 121 Operating According to the Most Complete Functional Configuration, Represented in FIG. 12.

Compared to the Joule-Ericsson cycles on their own and the sole "drive unit", the novelty introduced with this configuration regards the realization of a "combined" operating cycle, where the thermal fluid is a mixture of air and water (transformed into superheated vapour); this ensures the lubrication of the cylinder (where the pistons slide) and enables a higher unit power to be obtained and a considerable improvement in the overall efficiency.

With reference to FIG. 12, in the position where the pistons are located, the following main steps of the cycle can be identified:

E1_Setting into Motion the Heat Machine 121.

Noting first of all that all control and regulating devices are powered via a specific auxiliary electric line (not represented), the start-up of the heat machine 121 takes place in the following manner:

- the primary shaft 17 (visible in FIG. 2*b*) and the whole transmission system that moves the six pistons 7*a*,7*b*, 7*c*,9*a*,9*b*,9*c* are set in rotation via the starter motor, thus creating the preliminary condition for start-up of the cycle;
- the condensate water pump 94 is activated;
- the water pump 99 is electrically powered up;
- the fan 92 is activated;
- the burner 40 is activated by acting on the regulation valve 91 (which controls the injection of fuel F) and the combustion process is started;
- when the circulating thermal fluid has reached the predetermined minimum operating condition, the drive unit 1 will be capable of producing the work necessary in order to be able to run autonomously.

E2_Start of the Cycle, Starting from the Step of Suctioning the Cooled Thermal Fluid.

The thermal fluid, exiting from the cooler 43 (at temperature T1), passes into the pipe 43', passes through the condensate trap 93 (where the water in the thermal fluid is condensed and separated from the air), passes into the pipe 93' at temperature T1', passes through the suctioning opening 15''' and, following the movement of the two pistons 9*c*-7*c* away from each other, is suctioned into the chamber 13'''.

E3_Step of Compression and Recovery of the Suctioned Thermal Fluid.

Following the movement of the two pistons 7*c*-9*a* towards each other, the previously suctioned air is compressed in the chamber 14' (up to the limit, which is normally preset with a minimum ratio of 1:4 and a maximum ratio of 1:20), undergoes an increase in temperature from T1' to T2, passes through the discharge opening 16''', the pipe 44' and the check valve 44*a* and ends up in the compensation tank 44, where it remains available for immediate use.

E4_Step of Preheating the Compressed Thermal Fluid.

With the intermittency determined by the rotation of the pistons and the resulting opening/closing of the inlet openings 15,15", the air flows out from the tank 44, passes through the pipe 44" and the check valve 44*b*, travels through the pipe 44', and passes into the regenerator 42 (where it undergoes an increase in temperature from T2 to T2').

E5_Step of Vaporizing/Superheating the Condensate Water.

Pushed by the high pressure pump 94, the condensate water previously extracted from the air by the trap 93, flows through the pipes 93" and 94' at temperature T1", passes through the evaporator 95, where it is heated/vaporized (changing in state from a liquid to a vapour, with an increase in temperature from T1" to Ta), travels through the pipe 95", passes through the superheater 96 (where it acquires further energy and undergoes an increase in temperature from Ta to Tb).

E6_Step of Injection of the Superheated Vapour in the Air Conduit.

The air, exiting from the regenerator 42, travels through the pipe 42', passes through the check valve 42*a* and passes into the pipe 42' where, via the injector 97, the superheated vapour conveyed in the pipe 96' is introduced. As a result of the mixing of the air with the superheated vapour, the thermal fluid undergoes an increase in energy and its temperature increases from T2' to T2", enabling the recovery of useful energy, which is schematically represented in the area Q96 in FIG. 10.

E7_Step of Superheating the Circulating Thermal Fluid.

The mixed thermal fluid travels through the pipe 97', passes through the heater 41 (adjacent to the combustion chamber 40A, provided with the multi-fuel burner 40), where it receives heat-energy and increases in temperature from T2" to T3.

E8_Step of Expanding the Superheated Thermal Fluid and Producing Useful Work.

When the pistons 7*a*-7*b*, by rotating in the annular cylinder in the direction of motion indicated by the arrows, open the inlet openings 15-15", the superheated thermal fluid flowing through the pipes 41'-41"-41''' is introduced into the expansion chambers 13' and 13", where it is expanded (decreasing in temperature from T3 to T4) and, by making the pistons rotate, produces useful work.

E9_Step of Expulsion and of Recovering Energy from the Exhausted Thermal Fluid.

Following the movement of the pistons 7*a*-9*b* and 7*b*-9*c* towards each other, the chambers 14' and 14" diminish in volume, the exhausted thermal fluid (already expanded in the previous cycle) is expelled from the drive unit 1, passes through the two discharge openings 16'-16", flows through the pipes 45'-45"-45'", passes through the regenerator 42 (where it surrenders part of the energy-heat still possessed and undergoes a first decrease in temperature from T4 to T4'), then passes into the pipe 42", passes through the evaporator 95, where it again surrenders part of the energy-heat possessed and undergoes a second decrease in temperature from T4' to T4", enabling the recovery of useful energy, which is schematically represented in the area Q95 in FIG. 10.

E10_Conclusion of the Cycle with Further Cooling of the Exhausted Thermal Fluid.

The thermal fluid passes into the pipe 95' and reaches the cooler 43, from where the cycle can continue and repeat itself in a continuous mode.

E11_Optimized Cooling of the Drive Unit 1, with Recovery of Energy.

The water cooled in the recuperator 98 (at temperature Tc) is constantly maintained in circulation by the pump 99, flows through the pipes 98'-99', passes through a specific interspace 2R formed in the drive unit 1, (where, by performing a cooling action, it undergoes an increase in temperature from Tc to Td), travels through the pipe 2', passes through the recuperator 100 (where it acquires heat-energy, increasing in temperature from Td to Te), travels through the pipe 100' and, finally, arrives at the recuperator 98, where its path ends. The interspace 2R constitutes a cooling unit for the drive unit 1. The pipes 2', 98', 99' and 100' constitute cooling pipes. The interspace 2R (or cooling unit) of the first recuperator 98, the second recuperator 100, the cooling pump 99 and the cooling pipes together constitute a cooling circuit of the heat machine.

E12_Recovery of Energy with the Optimization of the Process of Preheating the Combustion Air.

The combustion air drawn from the environment at temperature Th1 is pushed by the fan 92 and passes into the cooler 43 (where it acquires energy and increases in temperature to Th3), passes into the recuperator 98 (where it acquires further energy and increases in temperature to Th5). The preheated air is mixed in the burner 40 with the fuel conveyed through the regulation valve 91 and is introduced into the combustion chamber 40A, where the gas, mixed at a high temperature, can undergo optimal combustion, thus reducing harmful emissions.

E13_Recovery of Energy with a Reduction in the Temperature of the Combustion Fumes.

The hot fumes produced by combustion at temperature Th7 are first cooled to temperature Th6 (passing through the superheater 96), then further cooled to temperature Th4 (passing through the recuperator 100) and then, given that the function envisaged for the heat machine is also to provide energy-heat to be destined to auxiliary uses (space heating and/or production of domestic hot water, etc.), before the hot fumes are discharged into the atmosphere (through the conduit 102), all their residual energy is recovered by reducing their temperature as much as possible (it also being possible to recover further energy through their possible condensation). To achieve this purpose, use is made of a specific hydraulic circuit, where the following mode of conveyance is adopted: the incoming thermal fluid (normally water) from the auxiliary uses 103 passes into the pipe 103' and, pushed by the circulation pump 104, passes into the pipe 104', reaches the recuperator 101 at the low temperature Tf and then, on passing through it, thanks to the reduction in the temperature of the fumes from Th4 to Th2, it acquires energy-heat and heats up to the higher temperature Tg, so as to be made available, via the pipe 101', for the auxiliary uses 130, and for the intended purpose.

The pipes 101', 103' and 104' constitute auxiliary pipes. The auxiliary recuperator 101, the auxiliary pump 104 and the auxiliary pipes together constitute a cooling circuit of the heat machine 121.

The invention thus conceived is susceptible of numerous modifications and variants, all falling within the scope of the inventive concept, and the components mentioned may be replaced by other technically equivalent elements.

The invention achieves important advantages. First of all, the invention enables at least some of the drawbacks of the prior art to be overcome.

Furthermore, the heat machine and the associated method according to the present invention are capable of using a variety of heat sources and of generating mechanical energy (work), as they can be employed in any place and for any use, but preferably for the production of electrical energy.

Furthermore, the heat machine according to the present invention is characterized by a high thermodynamic efficiency and an excellent weight-power ratio.

In addition, the heat machine according to the present invention is characterized by a simple, easy to produce structure.

Furthermore, the heat machine according to the present invention is characterized by a reduced production cost.

The invention claimed is:

1. A heat machine for realizing a heat cycle, the heat machine operating with a thermal fluid and configured to function with a combined heat cycle using hot air and aqueous vapour, featuring unidirectional continuous motion of the thermal fluid, the heat machine comprising:

a drive unit comprising:

a casing delimiting therein an annular chamber and having dimensioned inlet or discharge openings in fluid communication with conduits external to the annular chamber, wherein each inlet or discharge opening is angularly spaced from the adjacent inlet and discharge openings so as to define an expansion/compression path for a working fluid in the annular chamber;

a first rotor and a second rotor rotatably installed in said casing;

wherein each one of the two rotors has three pistons that are slidable in the annular chamber; wherein the pistons of one of the rotors are angularly alternated with the pistons of the other rotor; wherein angularly adjacent pistons delimit six variable-volume chambers;

a primary shaft operatively connected to said first and second rotor;

a transmission that is operatively interposed between said first and second rotor and the primary shaft and configured to convert the rotational motion with respective first and second periodically variable angular velocities of said first and second rotor that are offset relative to each other into a rotational motion having a constant angular velocity of the primary shaft; wherein the transmission is configured to confer, on the periodically variable angular velocity of each of the rotors, six periods of variation for each complete revolution of the primary shaft;

wherein said drive unit is a rotary volumetric expander operating with said thermal fluid;

a first section of the drive unit, where, following the movement of the two pistons away from each other, the thermal fluid, passing through the inlet opening, is suctioned into the chamber;

a second section of said drive unit, where, following the movement of the two pistons towards each other, the previously suctioned thermal fluid is compressed in the chamber and then, on passing through the discharge opening, a pipe and a check valve, it is conveyed into a compensation tank;

a compensation tank configured to accumulate the compressed thermal fluid to make it available, via pipes and the check valve, for subsequent use thereof, in a continuous mode;

a regenerator, in fluid communication via pipes with said drive unit and configured to preheat the thermal fluid prior to its entry in a heater;

a heater configured to superheat the thermal fluid circulating in a serpentine coil, using the thermal energy produced by a burner;

a burner with a combustion chamber attached thereto, said burner being apt for operating with various types of fuel and being capable of supplying the necessary thermal energy to the heater;

a third section of said drive unit, in fluid communication with said heater, via pipes, and capable of receiving, via the inlet openings, the thermal fluid heated to a high temperature under pressure in the heater so as to have it expand in the chambers, which are delimited by the pistons, respectively, for the purpose of having said pistons rotate and produce work;

a fourth section of said drive unit, in fluid communication with the regenerator through the discharge openings and pipes, and wherein, due to the reduction in volume of the two chambers brought about by the movement of the two pairs of pistons towards each other, the exhausted thermal fluid is forcedly expelled;

wherein said regenerator, in fluid communication with said drive unit, is further configured to acquire heat-energy from the exhausted thermal fluid and to use it to preheat the thermal fluid to be sent to the heater.

2. The heat machine according to claim 1, wherein the first section of the drive unit is in fluid connection with the external environment via a pipe, so that the ambient air can be suctioned into the chamber, and wherein the heat machine comprises a metering pump in fluid connection with a distilled water tank and arranged so as to enable a predefined amount of distilled water to be injected in an air circuit by means of an injector, said predefined amount being capable of increasing the unit power of the drive unit and of ensuring lubrication of the cylinder.

3. The heat machine according to claim 1, comprising:

a cooler that is operatively interposed between the low temperature outlet of the regenerator and the inlet of the heater, wherein the thermal fluid, exiting from the cooler at temperature T1, passes into a pipe, passes through a condensate trap, where the water in the thermal fluid is condensed and separated from the air, passes into a pipe at temperature T1', passes through the suctioning opening and following the movement of the two pistons away from each other, is suctioned into the chamber of said first section, and wherein, pushed by a high-pressure pump, the condensate water previously extracted from the air by the trap travels through and reaches an injector arranged so as to inject, in an air circuit, a predefined amount of condensate water, which is capable of increasing the unit power of the drive unit and of ensuring lubrication of the cylinder.

4. The heat machine according to claim 1, comprising:

a cooler that is operatively interposed between the low temperature outlet of the regenerator and the inlet of the heater;

wherein the thermal fluid, exiting from the cooler at temperature T1, passes into a pipe, passes through a condensate trap, where the water in the thermal fluid is condensed and separated from the air, passes into a pipe at temperature T1', passes through the suctioning opening and following the movement of the two pistons away from each other, is suctioned into the chamber of said first section, and wherein, pushed by a high-pressure pump, the condensate water previously extracted from the air by the trap travels through the pipes and reaches an evaporator that is configured to heat and vaporize the condensate water and send it to an injector arranged so as to inject, in an air circuit, a predefined amount of aqueous vapour, which is capable of increasing the unit power of the drive unit and of ensuring lubrication of the cylinder, wherein said evaporator is operatively interposed, with its high temperature side, between said high pressure pump and said injector, and wherein said evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

5. The heat machine according to claim 1, comprising:

a cooler that is operatively interposed between the low temperature outlet of the regenerator and the inlet of the heater;

wherein the thermal fluid, exiting from the cooler at temperature T1, passes into a pipe, passes through a condensate trap, where the water in the thermal fluid is condensed and separated from the air, passes into a pipe at temperature T1', passes through the suctioning opening and following the movement of the two pistons away from each other, is suctioned into the chamber of said first section, and wherein, pushed by a high-pressure pump, the condensate water previously extracted from the air by the trap travels through the pipes and reaches an evaporator that is configured to heat and vaporize the condensate water and send it to a superheater, which, by extracting energy from the hot combustion fumes downstream of the burner, is configured to superheat the saturated vapour exiting from the evaporator, so as to supply energy thereto;

wherein said superheater is configured to send the vaporized and superheated condensate water to an injector, which is arranged so as to enable injection, in an air circuit, of a predefined amount of superheated aqueous vapour, which is capable of further increasing the unit power of the drive unit and of ensuring lubrication of the cylinder, wherein said evaporator is operatively interposed, with its high temperature side, between said high pressure pump and said superheater, and wherein said evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

6. The heat machine according to claim 5, and provided with a cooling circuit comprising:

a first recuperator, located upstream of the burner, where combustion air is drawn from the environment;

a cooling unit (interspace) associated with the drive unit;

a second recuperator, located downstream of the burner and the heater, along the exit path of the hot combustion fumes;

a plurality of cooling pipes connecting in series said first recuperator, said cooling unit and said second recuperator, so as to form a circular path, and bearing an amount of cooling fluid;

a cooling pump located in said circuit and that is operatively active on one pipe of said plurality of cooling pipes so as to bring about circulation of said cooling fluid in the cooling circuit;

wherein:

said first recuperator is configured to cool said cooling fluid by surrendering heat-energy to said combustion air;

said cooling unit is configured to cool the drive unit by transfer of heat-energy from the drive unit to the cooling fluid, which undergoes an increase in temperature;

said second recuperator is configured to heat said cooling fluid by acquiring heat-energy from the hot combustion fumes.

7. The heat machine according to claim 1, and equipped with an auxiliary hydraulic circuit comprising:

an auxiliary recuperator, located downstream of the burner and the heater, along the exit path of the hot combustion fumes;

a plurality of auxiliary pipes configured to pass through said auxiliary recuperator and to be connected with one or more auxiliary uses, an auxiliary pump, located in said circuit and that is operatively active on one pipe of said plurality of auxiliary pipes so as to bring about circulation in said auxiliary circuit;

wherein said auxiliary recuperator is configured to recover energy from the combustion fumes and to transmit it to the fluid circulating in said auxiliary circuit, said energy thus being available for said auxiliary uses.

8. The heat machine according to claim 1, further comprising:

a fan located upstream of the burner and configured to draw combustion air from the environment and to send it forcedly to said burner to feed the combustion process; and/or one or more check vales located along the pipes of the heat machine and configured to facilitate circulation of the thermal fluid in a unidirectional manner and prevent the outflow of the thermal fluid in the opposite direction.

9. A method for realizing a heat cycle, the method operating with a thermal fluid and being configured to function with a combined heat cycle using hot air and aqueous vapour, featuring unidirectional continuous motion of the thermal fluid, the method comprising the steps of:

arranging a heat machine, according to claim 1, carrying out the following steps:

starting up the primary shaft and the transmission of the drive unit, setting the pistons into motion;

activating the burner and starting up the combustion process;

when the thermal fluid circulating in the heat machine has reached a pre-established minimum operating state, the drive unit produces the work needed to be able to turn independently;

following the movement of the two pistons away from each other, the thermal fluid is suctioned into the chamber through the suctioning opening;

following the movement of the two pistons towards each other, the previously suctioned thermal fluid is compressed in the chamber, undergoes an increase in temperature from T1' to T2, passes through the discharge opening and reaches the compensation tank;

with the intermittency determined by the rotation of the pistons and the resulting opening/closing of the inlet openings, the thermal fluid flows out from the tank and passes through the regenerator, where it undergoes an increase in temperature from T2 to T2';

the thermal fluid passes through the heater, where it receives heat-energy and increases in temperature from T2" to T3;

rotating in the annular cylinder, when the pistons open the inlet openings, the superheated thermal fluid is admitted into the expansion chambers where it expands, with a decrease in its temperature from T3 to T4 and, as it makes the pistons rotate, it produces useful work;

following the movement of the pistons towards each other, the chambers diminish in volume, the exhausted thermal fluid is expelled from the drive unit, passes through the discharge openings, and through the regenerator, where it surrenders part of the heat-energy still possessed and undergoes a decrease in temperature from T4 to T4'.

10. The method according to claim 9, wherein in the step of suctioning the thermal fluid into the chamber, said thermal fluid is air suctioned from the environment at temperature T1', and wherein the method comprises the steps of:

drawing distilled water from the tank;

activating the metering pump and introducing a given amount of distilled water into the circuit by means of the injector; thereby bringing about a decrease in the temperature of the resulting thermal fluid from T2' to T2";

and wherein, following the step of passing through the regenerator, the exhausted thermal fluid is discharged into the atmosphere.

11. The method according to claim 9, further comprising the following steps:

the thermal fluid, exiting from the cooler at temperature T1, passes into a pipe, passes through a condensate trap, where the water in the thermal fluid is condensed and separated from the air, passes into a pipe at temperature T1', passes through the suctioning opening and following the movement of the two pistons away from each other, is suctioned into the chamber of said first section;

pushed by a high-pressure pump, the condensate water previously extracted from the air by the trap travels through pipes and reaches an injector arranged so as to enable injection, in an air circuit, of a predefined amount of condensate water, which is capable of increasing the unit power of the drive unit and of ensuring lubrication of the cylinder.

12. The method according to claim 9, further comprising the following steps:

the thermal fluid, exiting from the cooler at temperature T1, passes into a pipe, passes through a condensate trap, where the water in the thermal fluid is condensed and separated from the air, passes into a pipe at temperature T1', passes through the suctioning opening and following the movement of the two pistons away from each other, is suctioned into the chamber of said first section;

pushed by a high-pressure pump, the condensate water previously extracted from the air by the trap travels through the pipes and reaches an evaporator that is configured to heat and vaporize the condensate water and to send it to an injector arranged so as to enable injection, in air circuit, of a predefined amount of aqueous vapour, which is capable of increasing the unit power of the drive unit and of ensuring lubrication of the cylinder;

wherein said evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

13. The method according to claim 9, further comprising the following steps:

the thermal fluid, exiting from the cooler at temperature T1, passes into a pipe, passes through a condensate trap, where the water in the thermal fluid is condensed and separated from the air, passes into a pipe at temperature T1', passes through the suctioning opening and following the movement of the two pistons away from each other, is suctioned into the chamber of said first section;

pushed by a high-pressure pump, the condensate water previously extracted from the air by the trap travels through the pipes and reaches an evaporator that is configured to heat and vaporize the condensate water and to send it to a superheater, which, by extracting energy from the hot combustion fumes downstream of the burner, is configured to superheat the saturated vapour exiting from the evaporator, so as to supply energy thereto;

wherein said superheater is configured to send the superheated aqueous vapour to an injector, which is arranged so as to enable injection, in an air circuit, of a predefined amount of said superheated aqueous vapour, which is capable of further increasing the unit power of the drive unit, of increasing the overall yield and of ensuring lubrication of the cylinder, and wherein said evaporator is configured to receive as incoming fluid, on its low temperature side, the exhausted thermal fluid expelled from the outlet of the drive unit, so as to acquire residual heat-energy from this exhausted thermal fluid and to use it to preheat the thermal fluid to be sent to the heater.

14. The method according to claim 13, further comprising the following steps:

arranging a cooling circuit, comprising:

a first recuperator, located upstream of the burner, where combustion air is drawn from the environment;

a cooling unit associated with the drive unit;

a second recuperator, located downstream of the burner and the heater, along the exit path of the hot combustion fumes;

a plurality of cooling pipes connecting in series said first recuperator, said cooling unit and said second recuperator, so as to form a circular path, and bearing an amount of cooling fluid;

a cooling pump located in said circuit and that is operatively active on one pipe of said plurality of cooling pipes so as to bring about circulation of said cooling fluid in the cooling circuit;

carrying out the following steps:

cooling the cooling fluid by means of said first recuperator by surrendering heat-energy to said combustion air;

cooling, by means of said cooling unit, the drive unit by transfer of heat-energy from the drive unit to the cooling fluid, which undergoes an increase in temperature;

heating, by means of said second recuperator, said cooling fluid by acquiring heat-energy from the hot combustion fumes.

15. The method according to claim 9, further comprising the following steps:

arranging an auxiliary hydraulic circuit, comprising:

an auxiliary recuperator, located downstream of the burner and the heater, along the exit path of the hot combustion fumes;

a plurality of auxiliary pipes configured to pass through said auxiliary recuperator and to be connected with one or more auxiliary uses;

an auxiliary pump, located in said circuit and that is operatively active on one pipe of said plurality of auxiliary pipes so as to bring about circulation in said auxiliary circuit;

carrying out the following steps:

recovering energy from the combustion fumes, by means of said auxiliary recuperator;

transmitting said energy to the fluid circulating in said auxiliary circuit;

making said energy available for auxiliary uses.

* * * * *